US009513571B2

(12) United States Patent
Sugahara et al.

(10) Patent No.: US 9,513,571 B2
(45) Date of Patent: Dec. 6, 2016

(54) MAGNETIC CARRIER, TWO-COMPONENT DEVELOPER, DEVELOPER FOR REPLENISHMENT, AND IMAGE FORMING METHOD

(71) Applicant: CANON KABUSHIKI KAISHA, Tokyo (JP)

(72) Inventors: Nobuyoshi Sugahara, Tokyo (JP); Hironori Minagawa, Moriya (JP); Yuto Onozaki, Shimotsuma (JP); Minoru Yoshifuku, Iga (JP); Wakashi Iida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 14/290,606

(22) Filed: May 29, 2014

(65) Prior Publication Data

US 2014/0356782 A1 Dec. 4, 2014

(30) Foreign Application Priority Data

May 30, 2013 (JP) ..... 2013-113775

(51) Int. Cl.

| | |
|---|---|
| ***G03G 9/113*** | (2006.01) |
| ***G03G 9/107*** | (2006.01) |
| ***G03G 9/083*** | (2006.01) |
| ***G03G 13/08*** | (2006.01) |

(52) U.S. Cl.

CPC ..... *G03G 9/1132* (2013.01); *G03G 9/083* (2013.01); *G03G 9/107* (2013.01); *G03G 9/1075* (2013.01); *G03G 9/1131* (2013.01); *G03G 13/08* (2013.01)

(58) Field of Classification Search

CPC ..... G03G 9/10; G03G 9/1075; G03G 9/1132; G03G 9/1136

See application file for complete search history.

(56) References Cited

U.S. PATENT DOCUMENTS

2009/0263739 A1* 10/2009 Sugiura ..... G03G 9/107 430/111.32

FOREIGN PATENT DOCUMENTS

| | | | |
|---|---|---|---|
| EP | 2312397 | A1 | 4/2011 |
| EP | 2312398 | A1 | 4/2011 |
| EP | 2312400 | A1 | 4/2011 |
| JP | H04-093954 | A | 3/1992 |
| JP | 2006-337579 | A | 12/2006 |
| JP | 2009-175666 | A | 8/2009 |
| JP | 2011-158830 | A | 8/2011 |
| JP | 4898959 | B2 | 3/2012 |
| JP | 2012-173315 | A | 9/2012 |

* cited by examiner

*Primary Examiner* — Peter Vajda

(74) *Attorney, Agent, or Firm* — Canon USA, Inc., IP Division

(57) ABSTRACT

A magnetic carrier contains a resin-filled magnetic core particle and a resin covering layer provided on a surface of the resin-filled magnetic core particle. The resin-filled magnetic core particle is a porous magnetic particle containing a resin in pores thereof. The magnetic carrier has a 50% particle diameter (D50) of 30.0 μm or more and 80.0 μm or less on a volume basis. An electric current flowing through the magnetic carrier at a voltage of 500 V ranges from 8.0 to 50.0 μA.

A proportion JR1 of a composition that is made up of the resin in a magnetic carrier portion of a region R1 and a proportion JR2 of the composition in a magnetic carrier portion of a region R2 satisfy the following relationship. The region R1 and the region R2 are illustrated in FIG. 1.

$$1.20 \leq JR2/JR1 \leq 2.00.$$

11 Claims, 4 Drawing Sheets

MAGNETIC CARRIER, TWO-COMPONENT DEVELOPER, DEVELOPER FOR REPLENISHMENT, AND IMAGE FORMING METHOD

BACKGROUND OF THE INVENTION

Field of the Invention

The present invention relates to a magnetic carrier, a two-component developer, and a developer for replenishment for use in an image forming method for visualizing an electrostatic image by electrophotography, and an image forming method involving the use of the magnetic carrier, the two-component developer, and the developer for replenishment.

Description of the Related Art

In typical electrophotographic image forming methods, electrostatic latent images are formed on an electrostatic latent image bearing member using various means. Toner is applied to the electrostatic latent images, and the electrostatic latent images are developed. The development is widely performed using a two-component development system. In the two-component development system, carrier particles called a magnetic carrier are mixed with toner, and the toner bears an adequate amount of positive or negative charge due to triboelectric charging. The electric charge is used as driving force for the development.

In the two-component development system, the magnetic carrier has functions of agitation, conveyance, and charging of a developer. Thus, the functions of the magnetic carrier can be clearly separated from the functions of the toner. Thus, the two-component development system has the advantage that the performance of the developer can be easily controlled.

With recent technological advances in electrophotography, there is a growing demand for higher-definition apparatuses and higher stability of image quality as well as higher-speed and longer-life apparatuses. In order to meet such a demand, there is a demand for a higher-performance magnetic carrier.

Reduction in density variation and, in the case of full color, color variation during long-term use is proposed in Japanese Patent Laid-Open No. 4-93954. A carrier described in Japanese Patent Laid-Open No. 4-93954 is characterized in that a magnetic core material of the carrier has concavities and convexities, and the magnetic core material coated with a resin has uncoated convexities. Although this can improve the density variation and color variation, magnetic carrier particles having a high specific gravity impose a load on toner in recent high-speed copying, and the developer has a short lifetime. Thus, the image quality and adaptability to environmental changes must be further improved.

A magnetic carrier that contains a porous magnetic core having pores and a low specific gravity has been proposed in Japanese Patent Laid-Open Nos. 2012-173315, 2006-337579, 2009-175666, and 2011-158830, and Japanese Patent No. 4898959). Such a magnetic carrier can improve the lifetime of the developer, fogging, carrier adhesion, image-density irregularities, and resistance to leakage. However, such a magnetic carrier causes another problems, such as blank dots or coarseness. Thus, there is an urgent need for the development of a magnetic carrier and a two-component developer that can solve these problems, and an image forming method involving the use of the magnetic carrier and the two-component developer.

SUMMARY OF THE INVENTION

The present inventors found that a magnetic carrier that contains core particles each constituted by a porous magnetic particle and has a particular resin abundance ratio in a cross section of the magnetic carrier as described below has high blank dot resistance and resistance to coarseness of an image and maintains its developing performance.

The present invention provides a magnetic carrier that contains a resin-filled magnetic core particle, which is constituted by a porous magnetic particle and a resin disposed in pores of the porous magnetic particle, and a resin covering layer provided on a surface of the resin-filled magnetic core particle.

The magnetic carrier has a 50% particle diameter (D50) of 30.0 μm or more and 80.0 μm or less on a volume basis.

An electric current flowing through the magnetic carrier at a voltage of 500 V ranges from 8.0 to 50.0 μA.

A proportion JR1 of a composition that is made up of the resin in a magnetic carrier portion of a region R1 and a proportion JR2 of the composition in a magnetic carrier portion of a region R2 satisfy the following relationship. The region R1 and the region R2 are defined as described below.

$$1.20 \leq JR2/JR1 \leq 2.00$$

Definition of Region R1:

A line segment having a maximum length is drawn on a cross section image of the magnetic carrier. Two straight lines A and B parallel to the line segment and separated from the line segment by 2.5 μm are drawn. A straight line C that passes through a point of contact between the line segment and a surface of the resin-filled magnetic core particle and is perpendicular to the line segment is drawn. A straight line D that is parallel to the straight line C, is closer to the center of the magnetic carrier than the straight line C, and is separated from the straight line C by 5.0 μm is drawn. The region R1 refers to a region surrounded by the straight lines A, B, and D and the circumference of the resin-filled magnetic core particle.

Definition of Region R2:

A straight line E that is parallel to the straight line D, is closer to the center of the magnetic carrier than the straight line D, and is separated from the straight line D by 5.0 μm is drawn. The region R2 refers to a region surrounded by the straight lines A, B, D, and E.

The present invention also provides a two-component developer composed of a toner and a magnetic carrier. The toner contains a binder resin, a colorant, and a release agent. The magnetic carrier is the magnetic carrier described above.

The present invention also provides a developer for replenishment for use in an image forming method, the image forming method, involving charging an electrostatic latent image bearing member; forming an electrostatic latent image on a surface of the electrostatic latent image bearing member; developing the electrostatic latent image using a two-component developer in a developing unit to form a toner image; transferring the toner image to a transfer material optionally via an intermediate transfer member; and fixing the transferred toner image on the transfer material, wherein the developer for replenishment is supplied to the developing unit in response to a decrease in the concentration of toner in the two-component developer in the developing unit and, if necessary, an excess of the magnetic carrier in the developing unit is discharged from the developing unit, the developer for replenishment contains a magnetic carrier for replenishment and a toner, the toner containing a binder resin, a colorant, and a release agent, and the amount of toner is 2 parts by mass or more and 50 parts by mass or less per part by mass of the magnetic carrier for replenishment, and the magnetic carrier for replenishment is the magnetic carrier described above.

The present invention also provides an image forming method, involving: charging an electrostatic latent image bearing member; forming an electrostatic latent image on a surface of the electrostatic latent image bearing member; developing the electrostatic latent image using a two-component developer in a developing unit to form a toner image; transferring the toner image to a transfer material optionally via an intermediate transfer member; and fixing the transferred toner image on the transfer material, wherein a developer for replenishment is supplied to the developing unit in response to a decrease in the concentration of toner in the two-component developer in the developing unit and, if necessary, an excess of the magnetic carrier in the developing unit is discharged from the developing unit, the developer for replenishment contains a magnetic carrier for replenishment and a toner, the toner containing a binder resin, a colorant, and a release agent, and the amount of toner is 2 parts by mass or more and 50 parts by mass or less per part by mass of the magnetic carrier for replenishment, and the magnetic carrier for replenishment is the magnetic carrier described above.

Further features of the present invention will become apparent from the following description of exemplary embodiments with reference to the attached drawings.

DESCRIPTION OF THE EMBODIMENTS

A magnetic carrier according to an embodiment of the present invention contains a porous magnetic particle, wherein a proportion JR1 of a composition that is made up of a resin in a magnetic carrier portion of a region R1 and a proportion JR2 of the composition in a magnetic carrier portion of a region R2 satisfy the following relationship, the region R1 and the region R2 being defined as described below.

$$1.20 \leq JR2/JR1 \leq 2.00$$

This relationship means that a resin ratio in the vicinity of a surface layer of the magnetic carrier is lower than a resin ratio in the interior of the magnetic carrier. Such a structure can promote charge relaxation and stabilize the covering layer.

Figure 1:
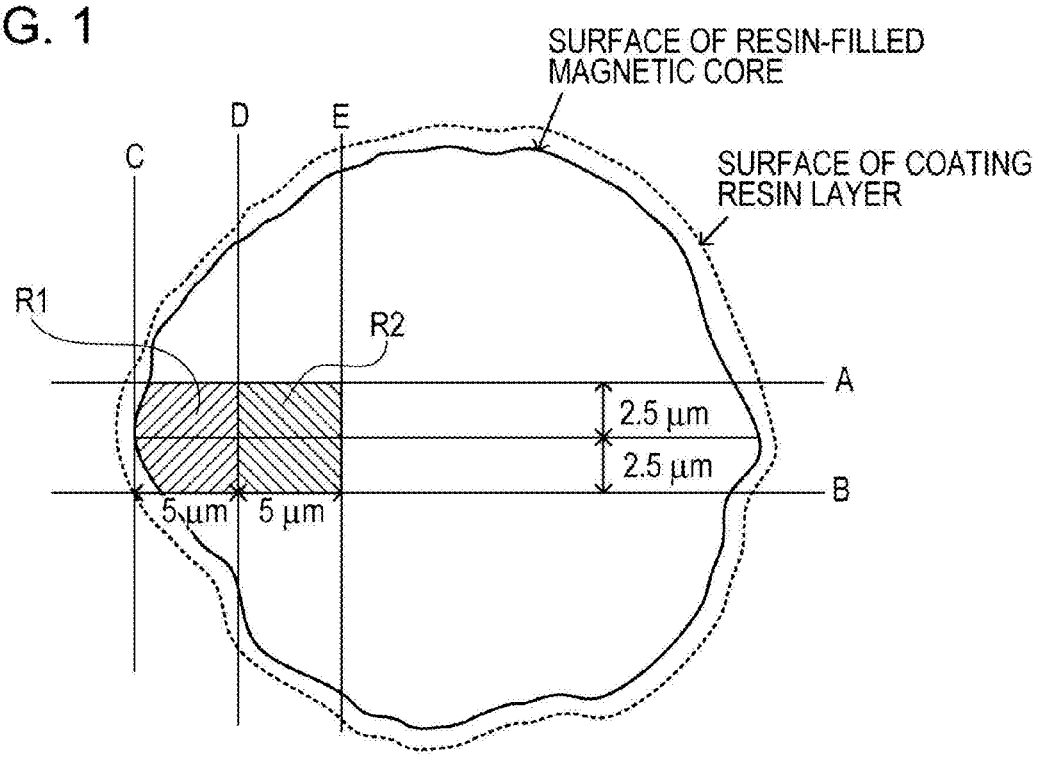
FIG. 1 is an explanatory view of regions R1 and R2 in a magnetic carrier according to an embodiment of the present invention.

The definition of the region R1 will be described below with reference to FIG. 1.

A line segment having a maximum length is drawn on a cross section image of the magnetic carrier. Two straight lines A and B parallel to the line segment and separated from the line segment by 2.5 μm are drawn. A straight line C that passes through a point of contact between the line segment and a surface of the resin-filled magnetic core particle and is perpendicular to the line segment is drawn. A straight line D that is parallel to the straight line C, is closer to the center of the magnetic carrier than the straight line C, and is separated from the straight line C by 5.0 μm is drawn. The region R1 refers to a region surrounded by the straight lines A, B, and D and the circumference of the resin-filled magnetic core particle.

A straight line E that is parallel to the straight line D, is closer to the center of the magnetic carrier than the straight line D, and is separated from the straight line D by 5.0 μm is drawn. The region R2 refers to a region surrounded by the straight lines A, B, D, and E.

The resin abundance ratio (JR1) of a magnetic carrier surface layer portion is slightly smaller than the resin abundance ratio (JR2) of a portion inside the magnetic carrier surface layer portion. Such a structure can promote charge relaxation and stabilize the covering layer.

In general, a smaller resin abundance ratio of the surface layer portion results in a smaller thickness of the resin layer covering protruded portions of the porous magnetic particle. This broadens a conductive path through which electric charges can flow in the magnetic carrier surface layer portion. An excessively broad conductive path, however, results in a low electrical resistance of the surface layer portion, and electric charges flow into an electrostatic latent image through the magnetic carrier. This results in significant "coarseness".

On the other hand, an excessively large resin abundance ratio of the surface layer portion results in a narrow conductive path of the surface layer portion. Thus, a "blank dot" may be conspicuous at a boundary between a low-density portion and a high-density portion. The "blank dot" is a dot that lacks toner.

As a result of extensive studies to prevent the "coarseness" and "blank dot", the present inventors found that it is important to satisfy the relationship of $1.20 \leq JR2/JR1 \leq 2.00$. This is probably because the magnetic carrier surface layer has a larger conducting area than conventional carriers, and the covering layer forms an appropriate thin layer and has controlled surface resistivity. This is also probably because of reduced variations in the electrical resistance of the surface layer and the interior of the magnetic carrier and a uniform electric charge conductive path in the magnetic carrier. In order to prevent the "coarseness" and "blank dot" for a long time, the relationship of $1.30 \leq JR2/JR1 \leq 1.90$ may be satisfied.

In known magnetic carriers, the resin abundance ratio of the surface layer portion is equal to or greater than the resin abundance ratio of the interior. The present invention is achieved by controlling the shape of the porous magnetic particle and the filling of the resin in the interior of the porous magnetic particle.

A JR2/JR1 ratio of less than 1.20 results in little or no charge relaxation and large variations in image density or color due to blank dots or charge-up. A JR2/JR1 ratio of more than 2.00 results in a smaller thickness of the surface layer and excessive charge relaxation, resulting in low resistance to coarseness or increased carrier adhesion.

Figure 2:
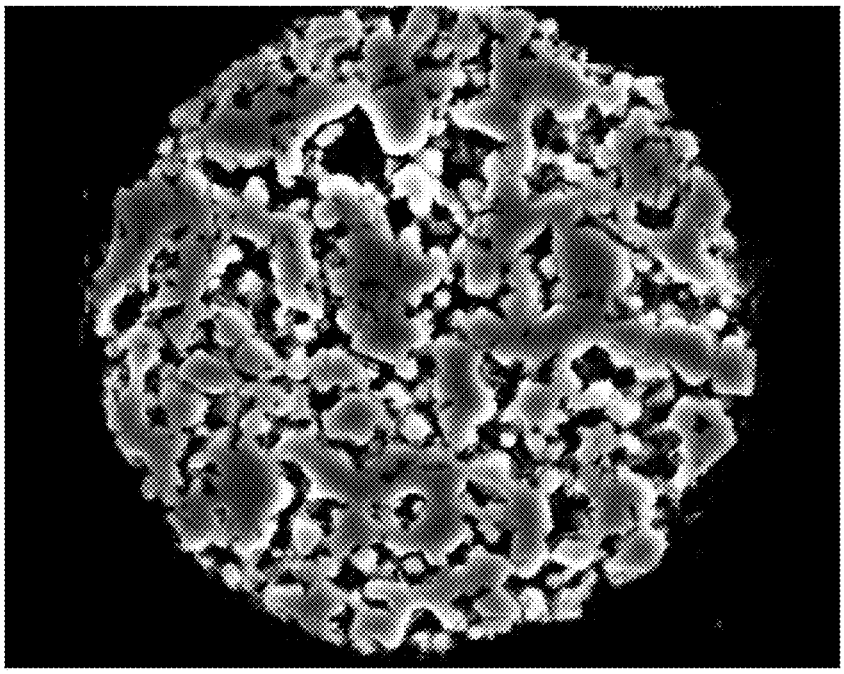
FIG. 2 is a cross section of a porous magnetic particle according to an embodiment of the present invention.

FIG. 2 is a cross section of a porous magnetic particle according to an embodiment of the present invention. As shown in FIG. 2, when the proportion of a ferrite component in the vicinity of the surface is higher than the proportion of the ferrite component in the interior of the particle, it is easy to control JR2 /JR1 within the range of the present invention.

A method for producing a porous magnetic particle having such a structure will be described later.

An electric current flowing through the magnetic carrier at a voltage of 500 V ranges from 8.0 to 50.0 μA. An electric current within this range results in a lower occurrence of blank dots and high resistance to coarseness. The electric current correlates with the resin abundance ratio, the amount of resin in the carrier, and the electrical resistance of the carrier.

A magnetic carrier according to an embodiment of the present invention contains a resin-filled magnetic core particle and a resin covering layer disposed on a surface of the resin-filled magnetic core particle. The resin-filled magnetic core particle is a porous magnetic particle containing a resin in pores thereof. This allows the charge relaxation of the magnetic carrier to be controlled and improves not only the lifetime of the developer but also the stability of image density and color.

A porous magnetic particle according to an embodiment of the present invention can have a peak pore diameter, which provides the maximum differential pore volume in the pore diameter range of 0.1 μm or more and 3.0 μm or less, of 0.40 μm or more and 1.00 μm or less. A peak pore diameter within this range results in appropriate particle strength and prevention of scattering or adhesion of the carrier. In addition, such a magnetic carrier rarely causes damage to a member of an electrophotographic apparatus and is less likely to produce image defects after long-term operation.

When the proportion JR1 of a composition that is made up of the resin and the proportion JR2of the composition satisfy the relationship of 1.20≤JR2/JR1≤2.00, and the porous magnetic particle has a pore diameter of 0.40 μm or more and 1.00 μm or less, these result in a significant improvement in the coatability of the resin composition and the coating film strength. This is probably because of the following reason.

A porous magnetic particle according to an embodiment of the present invention has a small pore diameter and a large number of pores. When the proportion of the composition that is made up of the resin is within the range of the present invention, a coating film interface is disposed further inside the porous magnetic particle than the surface layer. Thus, the interface area is further decreased.

This increases the contact area and adhesion between the resin composition and the porous magnetic particle and increases the strength of the coating film interface due to the surface tension of the coating film, thus remarkably increasing the strength of the coating film. Consequently, image stability after long-term operation is also improved.

Pores of the porous magnetic particle having a pore diameter of 0.1 μm or more and 3.0 μm or less may have a pore volume of 20 $mm^3/g$ or more and 100 $mm^3/g$ or less. The pore volume is an accumulated value of differential pore volumes. A pore volume within this range results in appropriate particle strength. Thus, the magnetic carrier can achieve a balance between robustness and little likelihood of causing damage to a member of an electrophotographic apparatus.

The amount of resin in a magnetic carrier according to an embodiment of the present invention can be 3.0 parts by mass or more and 9.0 parts by mass or less per 100 parts by mass of the porous magnetic particle. This results in an appropriate electric current, reduced coarseness, and improved density stability. This also prevents blank dot and deterioration in developing performance after long-term operation.

The porous magnetic particle can have high developing performance when the porous magnetic particle has a specific resistance of $1.0\times10^7$ Ω·cm or more and $1.0\times10^9$ Ω·cm or less at an electric field strength of 300 V/cm.

A method for producing a magnetic carrier according to an embodiment of the present invention will be described below.

Method for Producing Porous Magnetic Particle

A porous magnetic particle according to an embodiment of the present invention can be produced through the following steps.

The porous magnetic particle can be made of magnetite or ferrite. It is possible to control the porous structure and electrical resistance of the porous magnetic particle made of ferrite.

Ferrite is a sintered body having the following general formula.

$$(M1_2O)x(M2O)y(Fe_2O_3)z$$

(wherein M1 denotes a monovalent metal, M2 denotes a divalent metal, each of x and y is 0 or more and 0.8 or less, and z is more than 0.2 and less than 1.0, provided that x+y+z=1.0.)

M1 and M2 may be at least one metal atom selected from the group consisting of Li, Fe, Mn, Mg, Sr, Cu, Zn, and Ca.

In order to maintain appropriate magnetization and a desired pore diameter of the magnetic carrier, it is necessary to optimize the concavities and convexities on the surface of the porous magnetic core particle. It is also necessary to control the ferritization rate without difficulty and optimize the specific resistance and magnetic force of the porous magnetic core. In this respect, the porous magnetic particle may be made of ferrite containing a Mn element, such as Mn ferrite, Mn—Mg ferrite, Mn—Mg—Sr ferrite, or Li—Mn ferrite.

The steps of producing the porous magnetic particle using ferrite will be described in detail below.

Step 1 (Weighing and Mixing Step):

The raw materials of ferrite are weighed and mixed together. Examples of the raw materials of ferrite include, but are not limited to, Li, Fe, Mn, Mg, Sr, Cu, Zn, and Ca particles, oxides, hydroxides, carbonates, and oxalates. Hydroxides or carbonates tend to result in a greater pore volume than oxides. A mixer, such as a ball mill, a planetary mill, a Giotto mill, or a vibrating mill may be used. A ball mill has high mixing performance. More specifically, the weighed ferrite raw materials and balls are charged into a ball mill. The weighed ferrite raw materials are pulverized and mixed for 0.1 hours or more and 20.0 hours or less.

Step 2 (Calcination Step):

The pulverized and mixed ferrite raw materials are pelletized, for example, with a pressure forming machine and are calcined. The calcination step is important for the production of a magnetic carrier according to an embodiment of the present invention. For example, the raw materials are calcined to form ferrite at a temperature of 1050° C. or more and 1100° C. or less for 2.5 hours or more and 5.0 hours or less. The amounts of raw materials are appropriately controlled so as to promote ferritization. Ferritization can be promoted in a low-oxygen atmosphere, such as a nitrogen atmosphere. Examples of a furnace used in calcination include, but are not limited to, burner furnaces, rotary furnaces, and electric furnaces.

Step 3 (Pulverization Step):

The calcined ferrite prepared in the step 2 is pulverized in a pulverizer. Any pulverizer that can achieve a desired particle diameter may be used. The calcined ferrite in the present embodiment has higher hardness than known calcined products because of promoted ferritization. The pulverization intensity must therefore be increased to achieve the desired particle diameter. It is important to increase the pulverization intensity and thereby decrease the particle diameter of pulverized calcined ferrite and control the particle size distribution.

The particle diameter and particle size distribution of the pulverized calcined ferrite correlate with the average pore diameter and pore volume of a porous magnetic core particle and the degree of concavities and convexities on the surface of the magnetic carrier. Thus, the control of the particle diameter and particle size distribution of the pulverized calcined ferrite contributes to a controlled resin abundance ratio of the magnetic carrier.

The particle size distribution of the pulverized calcined ferrite can be controlled by changing the material of balls of a ball mill or beads of a bead mill or changing the operation time. More specifically, balls having a high specific gravity or a long pulverization time may be employed to decrease the particle diameter of calcined ferrite. The material of the balls or beads is not particularly limited, provided that a desired particle diameter and a desired particle size distribution can be achieved. Examples of the materials of the balls or beads include, but are not limited to, glasses, such as soda-lime glass (specific gravity 2.5 g/cm$^3$), soda-free glass (specific gravity 2.6 g/cm$^3$), and high specific gravity glass (specific gravity 2.7 g/cm$^3$), quartz (specific gravity 2.2 g/cm$^3$), titania (specific gravity 3.9 g/cm$^3$), silicon nitride (specific gravity 3.2 g/cm$^3$), alumina (specific gravity 3.6 g/cm$^3$), zirconia (specific gravity 6.0 g/cm$^3$), steel (specific gravity 7.9 g/cm$^3$), and stainless steel (specific gravity 8.0 g/cm$^3$). Alumina, zirconia, and stainless steel have high wear resistance. The size of the balls or beads is not particularly limited, provided that a desired particle diameter and a desired particle size distribution can be achieved. For example, the balls may have a diameter of 4 mm or more and 60 mm or less. The beads may have a diameter of 0.03 mm or more and 5 mm or less. Wet ball mills and wet bead mills have higher pulverization efficiency than dry ball mills and dry bead mills because the pulverized product does not rise.

A hard calcined product in this embodiment can first be roughly pulverized in a dry system and then can be pulverized in a wet system to adjust the particle diameter.

Step 4 (Granulation Step):

A dispersant, water, a binder, and, if necessary, a pore modifier are added to the pulverized calcined ferrite. The pore modifier may be a foaming agent or resin fine particles. The binder may be poly(vinyl alcohol). In the case that calcined ferrite is pulverized in a wet system in the step 3, considering water in the ferrite slurry, a binder and, if necessary, a pore modifier can be added to the pulverized calcined ferrite.

The ferrite slurry is dried and granulated in a spray dryer at a temperature of 100° C. or more and 200° C. or less. Any spray dryer that can achieve a desired particle diameter may be used.

The dispersant and the binder in the granulated product are burnt at a temperature of 600° C. or more and 800° C. or less. When the combustion temperature is 700° C. or more, it is easy to control the pore diameter of a porous magnetic core particle within the range specified in the present invention.

Step 5 (Firing Step):

The granulated product is then fired at a temperature of 1000° C. or more and 1300° C. or less for one hour or more and 24 hours or less in an electric furnace at a controlled oxygen concentration. The pore volume depends on the firing temperature. For example, a high firing temperature results in a small pore volume. A porous magnetic core particle according to an embodiment of the present invention may have a pore volume of 20 mm$^3$/g or more and 100 mm$^3$/g or less.

Although ferritization has proceeded sufficiently in the calcination step, the time periods of temperature rise and drop in the range of 700° C. to 1100° C. at which ferritization proceeds are decreased to prevent ferritization. Thus, ferritization proceeds easily in a portion approximately 5.0 μm under the surface layer, and the resin abundance ratio (JR1) in the uppermost surface layer can easily be decreased.

The maximum temperature may be maintained for 3.0 hours or more and 5.0 hours or less. A rotary electric furnace, a batch type electric furnace, or a continuous electric furnace may be used. The oxygen concentration in the atmosphere during the firing step may be controlled using an inert gas, such as nitrogen, or a reducing gas, such as hydrogen or carbon monoxide. Firing in a rotary electric furnace may be performed multiple times in different atmospheres at different firing temperatures.

Step 6 (Separation Step):

Fired particles are crushed and, if necessary, a low magnetic energy product is separated by magnetic separation. Coarse particles or fine particles may be removed by air classification or screening with a sifter.

Surface Treatment Step:

If necessary, the electrical resistance of the porous magnetic particle may be adjusted by heating the surface of the porous magnetic particle at a low temperature to perform oxidation coating treatment. The oxidation coating treatment may be performed in a common rotary electric furnace or batch type electric furnace at 300° C. or more and 700° C. or less.

The resulting porous magnetic particle may have a 50% particle diameter (D50) of 28.0 μm or more and 78.0 μm or less on a volume basis such that the final magnetic carrier has a particle diameter of 30.0 μm or more and 80.0 μm or less. This can improve triboelectric charging of toner, provide satisfactory halftone image quality, and prevent fogging and carrier adhesion.

Method for Producing Resin-Filled Magnetic Core Particles

Pores of the porous magnetic particle may be filled with a filling resin composition by pouring a solution of the filling resin in a solvent into the pores of the porous magnetic core and removing the solvent. The solvent may be any solvent that can dissolve the filling resin. Examples of the solvent include, but are not limited to, organic solvents, such as toluene, xylene, cellosolve butyl acetate, methyl ethyl ketone, methyl isobutyl ketone, and methanol. Pores of the porous magnetic particle may be filled with a resin by impregnating the porous magnetic core with a resin solution using a dipping method, a spray method, a brushing method, or a fluidized-bed coating method and then vaporizing the solvent.

The dipping method may be performed by filling pores of the porous magnetic particle with a filling resin composition solution containing a filling resin and a solvent under reduced pressure and then removing the solvent by degassing or heating.

The impregnation of pores of the porous magnetic particle with a filling resin composition can be controlled by changing the degassing time and the solvent removal rate. The filling resin permeates the pores of the porous magnetic particle with time by the action of capillarity. In order for the proportion JR1 of a composition that is made up of the resin and the proportion JR2 of the composition to satisfy the relationship of 1.20≤JR2/JR1≤2.00 in the porous magnetic particle, the agitation time after dipping in the dipping method may be 1.5 hours or more and 3.0 hours or less.

If necessary, the porous magnetic core particle filled with the resin composition may be heated to allow the resin composition to adhere to the porous magnetic core particle. The porous magnetic core particle may be heated by external or internal heating, for example, using a fixed or fluid type electric furnace, a rotary electric furnace, or a burner furnace. Alternatively, the porous magnetic core particle may be baked using microwaves.

In order to facilitate the control of the amount of resin and improve the coatability of a coating resin composition, the amount of filling resin composition may be 1.0 parts by mass or more and 8.0 parts by mass or less per 100 parts by mass of the porous magnetic core particle.

In order to improve handling of a filling resin composition solution in terms of viscosity, improve filling in pores, and reduce the solvent removal time, the resin content of the filling resin composition solution may be 6 mass % or more and 50 mass % or less.

The filling resin of the filling resin composition to fill pores of the porous magnetic particle is not particularly limited and may be a permeating resin. The permeating resin fills the pores of the porous magnetic particle from the center to the surface of the porous magnetic particle. Thus, the pores may remain unfilled in the vicinity of the surface of the resin-filled magnetic core particles. As described above, concavities and convexities formed by the pores on the surface of the resin-filled magnetic core particle can provide appropriate surface tension of the coating resin composition.

The filling resin of the filling resin composition may be a thermoplastic resin or a thermosetting resin. A thermosetting resin does not dissolve in a solvent used in the coating of a magnetic carrier. In particular, a silicone resin can easily fill the pores. Examples of commercial silicone resins include, but are not limited to, straight silicone resins, such as KR-271, KR-251, and KR-255, manufactured by Shin-Etsu Chemical Co., Ltd., and SR2400, SR2405, SR2410, and SR2411, manufactured by Dow Corning Toray Co., Ltd., and modified silicone resins, such as KR206 (alkyd-modified), KR5208 (acryl-modified), and ES1001N (epoxy-modified), manufactured by Shin-Etsu Chemical Co., Ltd., and SR2110 (alkyd-modified) manufactured by Dow Corning Toray Co., Ltd.

The filling resin composition may contain a silane coupling agent. A silane coupling agent can be compatible with the filling resin and improve the wettability and adhesiveness between porous magnetic particles and the filling resin. Thus, the filling resin can fill the pores of the porous magnetic particle from the center of the porous magnetic particle. Thus, as described above, the concavities and convexities formed by the pores on the surface of the resin-filled magnetic core particle can provide appropriate surface tension of the coating resin composition.

Examples of the silane coupling agent include, but are not limited to, aminosilane coupling agents, which have a high affinity for the coating resin composition because of their functional groups.

The following is the reason that aminosilane coupling agents further improve the wettability and adhesiveness between porous magnetic particles and the filling resin and have a high affinity for the coating resin composition. Aminosilane coupling agents have a moiety that can react with an inorganic substance and a moiety that can react with an organic substance. It is generally believed that an alkoxy group reacts with an inorganic substance, and a functional group having an amino group reacts with an organic substance. Thus, an alkoxy group of an aminosilane coupling agent reacts with a portion of the porous magnetic core particle and improves the wettability and adhesiveness. A functional group having an amino group is oriented toward the filling resin. Therefore an affinity of porous magnetic particle for the coating resin composition improves.

The amount of silane coupling agent added to the filling resin composition preferably ranges from 1.0 to 20.0 parts by mass per 100 parts by mass of the filling resin. The amount of silane coupling agent more preferably ranges from 5.0 to 10.0 parts by mass to improve the wettability and adhesiveness between the porous magnetic particles and the filling resin.

Method for Producing Magnetic Carrier

A method for coating the resin-filled magnetic core particle with the coating resin composition is not particularly limited and may be a dipping method, a spray method, a brushing method, a dry method, or a fluidized-bed coating method. A dipping method that can control the ratio of a thin portion to a thick portion of the covering layer can make the most of the concavities and convexities characteristic of the surface of the porous magnetic core particle and improve the developing performance of the porous magnetic core particle. The reason for the improved developing performance is probably that the uneven surface profile of the magnetic core particle includes both a thin-film portion and a thick-film portion on the coating resin composition layer, and the local thin-film portion can effect charge relaxation.

The coating resin composition solution can be prepared using the same method as in a filling step. Granulation in a coating step may be prevented by changing the resin content of the coating resin composition solution, the internal temperature of a coating apparatus, the temperature or the degree of vacuum at which a solvent is removed, or the number of resin coating steps.

The amount of coating resin composition for covering the resin-filled magnetic core particle depends on the amount of resin in a magnetic carrier according to an embodiment of the present invention and may be 1.0 part by mass or more and 6.0 parts by mass or less per 100 parts by mass of the porous magnetic particle in terms of chargeability.

The resin of the coating resin composition for use in the covering layer is not particularly limited and may be a vinyl resin, which is a copolymer of a vinyl monomer having a cyclic hydrocarbon group in its molecular structure and another vinyl monomer. Coating with the vinyl resin can suppress the decrease in the amount of electrical charge in a high temperature and high humidity environment.

The following is the reason that the coating with the vinyl resin can suppress the decrease in the amount of electrical charge in a high temperature and high humidity environment. The application of the vinyl resin to the surface of resin-filled magnetic core particles includes a coating step of mixing the vinyl resin dissolved in an organic solvent with the resin-filled magnetic core particles and removing the solvent. In this step, the solvent is removed while the cyclic hydrocarbon group is oriented on the surface of the coating resin layer. Thus, the coating resin layer on which the hydrophobic cyclic hydrocarbon group is oriented is formed on the surface of the resulting magnetic carrier.

Examples of the cyclic hydrocarbon group include, but are not limited to, cyclic hydrocarbon groups having 3 or more and 10 or less carbon atoms, such as a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, and a bornyl group. The cyclic hydrocarbon group can be a cyclohexyl group, a cyclopentyl group, or an adamantyl group. A cyclohexyl group has a stable structure and exhibits good adhesion to the resin-filled magnetic core particles.

The vinyl resin may contain another monomer as a constituent to adjust the glass transition temperature (Tg).

Examples of the other monomer used as a constituent of the vinyl resin include, but are not limited to, known monomers, such as styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

The vinyl resin for use in the covering layer may be a graft polymer. A graft polymer can further improve the wettability between the covering layer and the porous magnetic core particles and form a uniform covering layer.

A graft polymer can be produced by graft polymerization after the formation of a main chain or by copolymerization of a macromonomer. Copolymerization of a macromonomer allows the molecular weight of a side chain to be easily controlled.

The macromonomer is not particularly limited and may be a methyl methacrylate macromonomer. A methyl methacrylate macromonomer can further improve the wettability between the covering layer and the porous magnetic cores.

The amount of macromonomer preferably ranges from 10 to 50 parts by mass, more preferably 20 to 40 parts by mass, per 100 parts by mass of the main chain copolymer of the vinyl resin.

The coating resin composition may contain electrically conductive particles and/or charge control particles or a charge control material. Examples of the electrically conductive particles include, but are not limited to, carbon black, magnetite, graphite, zinc oxide, and tin oxide. The filler effect of carbon black can provide the coating resin composition with appropriate surface tension and thereby improve the coatability of the coating resin composition.

The filler effect of carbon black that can improve the coatability of the coating resin composition results from the primary particle diameter and cohesiveness of the carbon black. Carbon black has a small primary particle diameter and a large specific surface area. Because of its high cohesiveness, carbon black forms agglomerates. Because of such a primary particle diameter and cohesiveness, a general relationship between the particle diameter and the specific surface area may not be applied to carbon black. More specifically, carbon black can have a particle diameter that allows the surface tension of the coating resin composition to be effective. Furthermore, a large specific surface area and many contact points of carbon black also allow the surface tension of the coating resin composition to be effective.

In order to adjust the electrical resistance of the magnetic carrier, the amount of electrically conductive particles added to the coating resin composition may be 0.1 parts by mass or more and 10.0 parts by mass or less per 100 parts by mass of the coating resin. Examples of the charge control particles include, but are not limited to, organometallic complex particles, organic metal salt particles, chelate compound particles, monoazo metal complex particles, acetylacetone metal complex particles, hydroxycarboxylic acid metal complex particles, polycarboxylic acid metal complex particles, polyol metal complex particles, poly(methyl methacrylate) resin particles, polystyrene resin particles, melamine resin particles, phenolic resin particles, nylon resin particles, silica particles, titanium oxide particles, and alumina particles. In order to control triboelectric charging, the amount of charge control particles added to the coating resin composition may be 0.5 parts by mass or more and 50.0 parts by mass or less per 100 parts by mass of the coating resin.

In order to prevent blank dots and coarseness, a magnetic carrier according to an embodiment of the present invention may have a specific resistance of $1.0\times10^{7}$ Ω·cm or more and $1.0\times10^{10}$ Ω·cm or less at an electric field strength of 2000 V/cm when measured using a specific resistance measurement method described below.

A toner in the present invention will be described in detail below.

Examples of a binder resin used in the present invention include, but are not limited to, vinyl resins, polyester resins, and epoxy resins. A vinyl resin or a polyester resin may be used as a binder resin in terms of chargeability or fixability. An image-forming apparatus using a polyester resin as a binder resin has great advantages.

If necessary, the binder resin may be mixed with a homopolymer or copolymer of a vinyl monomer, a polyester, a polyurethane, an epoxy resin, poly(vinyl butyral), rosin, modified rosin, a terpene resin, a phenolic resin, an aliphatic or alicyclic hydrocarbon resin, or an aromatic petroleum resin.

A mixture containing two or more resins having different molecular weights at an appropriate ratio may be used as a binder resin.

The binder resin preferably has a glass transition temperature in the range of 45° C. to 80° C., more preferably 55° C. to 70° C. The binder resin may preferably have a number-average molecular weight (Mn) in the range of 2,500 to 50,000 and a weight-average molecular weight (Mw) in the range of 10,000 to 1,000,000.

The binder resin may be the following polyester resin.

An alcohol component constitutes 45 to 55 mol % of the polyester resin, and an acid component constitutes 55 to 45 mol % of the polyester resin.

The polyester resin preferably has an acid value of 90 mgKOH/g or less, more preferably 50 mgKOH/g or less, and preferably has an OH value of 50 mgKOH/g or less, more preferably 30 mgKOH/g or less. This is because an increased number of end groups in the molecular chain results in greater environmental dependence of the charging characteristics of the toner.

The polyester resin preferably has a glass transition temperature in the range of 50° C. to 75° C., more preferably 55° C. to 65° C. The polyester resin preferably has a number-average molecular weight (Mn) in the range of 1,500 to 50,000, more preferably 2,000 to 20,000. The polyester resin preferably has a weight-average molecular weight (Mw) in the range of 6,000 to 100,000, more preferably 10,000 to 90,000.

When a toner according to an embodiment of the present invention is used as a magnetic toner, the magnetic toner may contain a magnetic material, for example, an iron oxide, such as magnetite, maghemite, or ferrite, an iron oxide containing another metal oxide, a metal, such as Fe, Co, or Ni, an alloy of the metal and another metal, such as Al, Co, Cu, Pb, Mg, Ni, Sn, Zn, Sb, Be, Bi, Cd, Ca, Mn, Se, Ti, W, or V, or a mixture thereof.

More specifically, the magnetic material may be triiron tetroxide ($Fe_3O_4$), diiron trioxide ($\gamma$-$Fe_2O_3$), iron zinc oxide ($ZnFe_2O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), an iron (Fe) powder, a cobalt (Co) powder, or a nickel (Ni) powder.

The amount of magnetic material may range from 20 to 150 parts by mass, preferably 50 to 130 parts by mass, more preferably 60 to 120 parts by mass, per 100 parts by mass of the binder resin.

The following nonmagnetic colorant may be used in the present invention.

Black colorants, such as carbon black and black colorants containing yellow, magenta, and cyan colorants.

Color pigments for a magenta toner, such as condensed azo compounds, diketopyrrolopyrrole compounds, anthraquinone, quinacridone compounds, a basic dye lake compounds, naphthol compounds, benzimidazolone compounds, thioindigo compounds, and perylene compounds, more specifically, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269, C.I. Pigment Violet 19, and C.I. Vat Red 1, 2, 10, 13, 15, 23, 29, and 35.

The colorant may be a pigment alone. In order to improve visibility and full-color image quality, a dye and a pigment may be used in combination.

Dyes for a magenta toner, for example, oil-soluble dyes, such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1, and basic dyes, such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Color pigments for a cyan toner, such as C.I. Pigment Blue 1, 2, 3, 7, 15:2, 15:3, 15:4, 16, 17, 60, 62, and 66, C.I. Vat Blue 6, C.I. Acid Blue 45, and copper phthalocyanine pigments that include 1 to 5 substituted phthalimidemethyl groups on the phthalocyanine skeleton.

Yellow color pigments, such as condensed azo compounds, isoindolinone compounds, anthraquinone compounds, azo metallic compounds, methine compounds, and allylamide compounds, more specifically, C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C.I. Vat Yellow 1, 3, and 20. Dyes, such as C.I. Direct Green 6, C.I. Basic Green 4, C.I. Basic Green 6, and C.I. Solvent Yellow 162, may also be used.

The amount of colorant used in the toner preferably ranges from 0.1 to 30 parts by mass, more preferably 0.5 to 20 parts by mass, most preferably 3 to 15 parts by mass, per 100 parts by mass of the binder resin.

The binder resin may be mixed with the colorant in advance to prepare a masterbatch. The colorant can be dispersed well in the toner by melt-kneading the colorant masterbatch and other raw materials (such as a binder resin and wax).

If necessary, a toner according to an embodiment of the present invention may contain a charge control agent to stabilize the chargeability of the toner. The amount of charge control agent may range from 0.5 to 10 parts by mass per 100 parts by mass of the binder resin.

The following charge control agents may be used.

The charge control agent may be a negative charge control agent for negatively charging the toner, such as an organometallic complex or a chelate compound. Examples of the negative charge control agent include, but are not limited to, monoazo metal complexes, aromatic hydroxycarboxylic acid metal complexes, and aromatic dicarboxylic acid metal complexes. Other examples of the negative charge control agent include, but are not limited to, aromatic hydroxycarboxylic acids, aromatic mono- and poly-carboxylic acids and metal salts thereof, anhydrides thereof, and esters thereof, and phenol derivatives of bisphenol.

The charge control agent may be a positive charge control agent for positively charging the toner. Examples of the positive charge control agent include, but are not limited to, nigrosine and nigrosines modified with fatty acid metal salts, onium salts, for example, quaternary ammonium salts, such as tributylbenzylammonium-1-hydroxy-4-naphthosulfonate and tetrabutylammonium tetrafluoroborate, and their analogs, such as phosphonium salts, and chelate pigments thereof, such as triphenylmethane dyes and lake pigments thereof (examples of laking agents include, but are not limited to, phosphotungstic acid, phosphomolybdic acid, phosphotungstenmolybdic acid, tannic acid, lauric acid, gallic acid, ferricyanic acid, and ferrocyanide), and higher fatty acid metal salts, for example, diorganotin oxides, such as dibutyltin oxide, dioctyltin oxide, and dicyclohexyltin oxide, and diorganotin borates, such as dibutyltin borate, dioctyltin borate, and dicyclohexyltin borate.

If necessary, the toner particles may contain one or two or more release agents. Examples of the release agents are described below.

Aliphatic hydrocarbon waxes, such as low molecular weight polyethylene, low molecular weight polypropylene, microcrystalline wax, and paraffin wax. Oxides of aliphatic hydrocarbon wax, such as oxidized polyethylene wax, and block copolymers thereof; waxes mainly composed of a fatty acid ester, such as carnauba wax, Sasolwax (trade name), and montanic acid ester wax; and partly or entirely deoxidized fatty acid esters, such as deoxidized carnauba wax.

The amount of release agent(s) preferably ranges from 0.1 to 20 parts by mass, more preferably 0.5 to 10 parts by mass, per 100 parts by mass of the binder resin.

The release agent(s) preferably has a melting point in the range of 65° C. to 130° C., more preferably 80° C. to 125° C., measured as a maximum endothermic peak temperature during heating with a differential scanning calorimeter (DSC). When the release agent(s) has a melting point in this temperature range, toner adhesion on a photosensitive member can be suppressed while the low-temperature fixation characteristics are maintained.

A toner according to an embodiment of the present invention may contain a fine powder as a fluidity improver, which can improve the flowability of toner particles. Examples of the fluidity improver include, but are not limited to, fluoropolymer powders, such as poly(vinylidene fluoride) fine powders and polytetrafluoroethylene fine powders; and silica fine powders, such as wet silica and dry silica, titanium oxide fine powders, and alumina fine powders subjected to surface treatment and hydrophobic treatment with a silane coupling agent, a titanium coupling agent, or silicone oil and having a hydrophobicity in the range of 30 to 80 when measured in a methanol titration test.

0.1 to 10 parts by mass, preferably 0.2 to 8 parts by mass, of inorganic fine particle per 100 parts by mass of the toner may be used in the present invention.

In a two-component developer composed of a toner and a magnetic carrier according to an embodiment of the present invention, the concentration of the toner may be 2 mass % or more and 15 mass % or less, preferably 4 mass % or more and 13 mass % or less.

In a developer for replenishment supplied to a developing unit in response to a decrease in the concentration of toner in a two-component developer in the developing unit, the amount of toner is 2 parts by mass or more and 50 parts by mass or less per part by mass of a magnetic carrier for replenishment.

An image-forming apparatus including a developing apparatus in which a magnetic carrier, a two-component developer, and a developer for replenishment according to an embodiment of the present invention are used will be described below. A developing apparatus used in a developing method according to the present invention is not limited to this developing apparatus.

<Image Forming Method>

Figure 3:
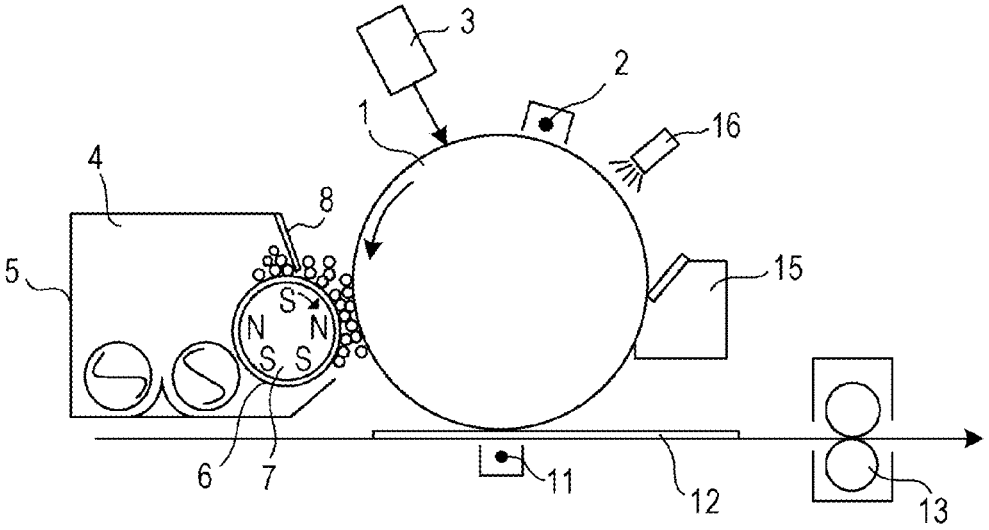
FIG. 3 is a schematic view of an image-forming apparatus used in the present invention.
Figure 4:
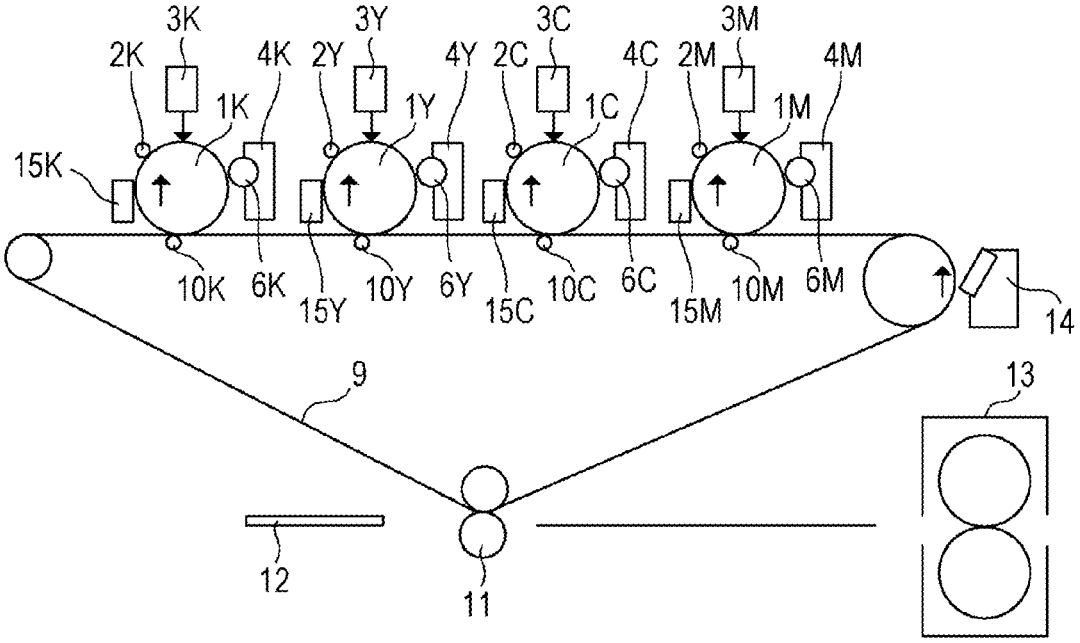
FIG. 4 is a schematic view of an image-forming apparatus used in the present invention.

In FIG. 3, an electrostatic latent image bearing member 1 rotates in the direction of the arrow. The electrostatic latent image bearing member 1 is charged using the charging unit 2. The surface of the charged electrostatic latent image bearing member 1 is exposed to light emitted from an exposure unit 3, which is an electrostatic latent image forming unit, to form an electrostatic latent image. A developing unit 4 includes a developer container 5, which contains a two-component developer, and a rotatable developer carrier 6. The developer carrier 6 includes magnets 7 as magnetic field generating means. At least one of the magnets 7 faces the latent image bearing member. The two-component developer is held on the developer carrier 6 in a magnetic field generated by the magnet 7. The amount of two-component developer is regulated by a regulating member 8. The two-component developer is conveyed to a developing section opposite the electrostatic latent image bearing member 1. The magnetic field generated by the magnet 7 forms a magnetic brush in the developing section. Application of a developing bias formed by superimposing an alternating electric field on a dc electric field visualizes the electrostatic latent image as a toner image. The toner image on the electrostatic latent image bearing member 1 is electrostatically transferred to a recording medium 12 using a charging device for transfer 11. As illustrated in FIG. 4, a toner image on an electrostatic latent image bearing member 1 may be temporarily transferred to an intermediate transfer member 9 and then electrostatically transferred to a transfer material (recording medium) 12. The recording medium 12 is then heated and pressed in a fixing unit 13 to fix the toner on the recording medium 12. The recording medium 12 is then ejected as an output image from the apparatus. After this transferring step, the residual toner on the electrostatic latent image bearing member 1 is removed with a cleaner 15. The electrostatic latent image bearing member 1 cleaned with the cleaner 15 is electrically initialized by photoirradiation using a pre-exposure lamp 16. These image forming steps are repeatedly performed.

FIG. 4 is a schematic view of a full-color image forming apparatus to which an image forming method according to the present invention is applied.

The arrangement of image forming units K, Y, C, and M and the rotation directions indicated by the arrows can be changed. K denotes black, Y denotes yellow, C denotes cyan, and M denotes magenta. In FIG. 4, electrostatic latent image bearing members 1K, 1Y, 1C, and 1M rotate in the directions of the arrows. The electrostatic latent image bearing members are charged using the charging units 2K, 2Y, 2C, and 2M. The surfaces of the charged electrostatic latent image bearing members are exposed to light emitted from exposure units 3K, 3Y, 3C, and 3M, which are electrostatic latent image forming units, to form an electrostatic latent image. The electrostatic latent image is then visualized as a toner image using a two-component developer carried by developer carriers 6K, 6Y, 6C, 6M disposed on developing units 4K, 4Y, 4C, and 4M. The toner image is then transferred to an intermediate transfer member 9 using intermediate charging devices for transfer 10K, 10Y, 10C, and 10M. The toner image is then transferred to a recording medium 12 using a charging device for transfer 11. The recording medium 12 is fixed by heating and pressurization in a fixing unit 13 and is outputted as an image. The residual toner is recovered with an intermediate transfer member cleaner 14, which is a cleaning member for the intermediate transfer member 9. In a developing method according to an embodiment of the present invention, more specifically, developing can be performed while an alternating voltage is applied to a developer carrier to form an alternating electric field in a developing region and a magnetic brush is in contact with a photosensitive member. In order to prevent carrier adhesion and improve dot reproducibility, the distance (S-D distance) between a developer carrier (developing sleeve) 6 and a photoconductive drum can be 100 μm or more and 1000 μm or less.

The peak-to-peak voltage (Vpp) of the alternating electric field is 300 V or more and 3000 V or less, preferably 500 V or more and 1800 V or less. The frequency of the alternating electric field depends on the process and is 500 Hz or more and 10000 Hz or less, preferably 1000 Hz or more and 7000 Hz or less. The waveform of an alternating current bias for forming the alternating electric field may be a triangular wave, a rectangular wave, or a sine wave. The waveform may have varying duty ratios. In order to accommodate variations in toner image forming speed, a developing bias voltage including a discontinuous alternating current bias voltage (an intermittent alternating superimposed voltage) can be applied to a developer carrier while developing.

A two-component developer containing a satisfactorily charged toner can be used to reduce the fog removal voltage (Vback) and reduce the primary charging of a photosensitive member, thereby increasing the lifetime of the photosensitive member. The Vback depends on the developing system and is preferably 200 V or less, more preferably 150 V or less. In order to produce a sufficient image density, the contrast potential can be 100 V or more and 400 V or less.

In the case that the frequency of the alternating electric field is less than 500 Hz, although the structure of an electrostatic latent image bearing member depends on the process speed, the structure may be the same as photosensitive members generally used in image-forming apparatuses. For example, the photosensitive member may include a conductive layer, an undercoat layer, a charge-generating layer, a charge-transport layer, and, if necessary, a charge-injection layer disposed in this order on an electrically conductive substrate, for example, made of aluminum or SUS.

The conductive layer, undercoat layer, charge-generating layer, and charge-transport layer may be those generally used in photosensitive members. The photosensitive member may include a charge-injection layer or a protective layer as the outermost layer.

<Measurement of Specific Resistance of Magnetic Carrier and Carrier Core>

The specific resistance of a magnetic carrier and a carrier core is measured with a measuring apparatus illustrated in FIG. 5. The specific resistance of a magnetic carrier is measured at an electric field strength of 2000 (V/cm). The specific resistance of a carrier core is measured at an electric field strength of 300 (V/cm).

Figure 5A:
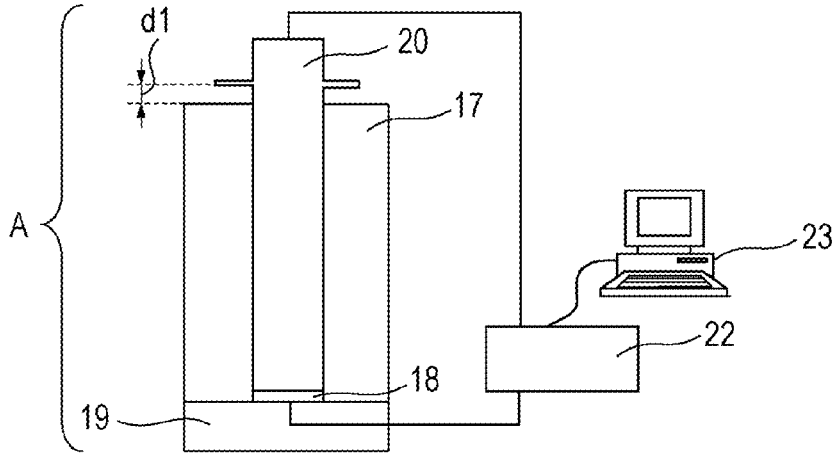
FIGS. 5A and 5B are schematic views of an apparatus for measuring the specific resistance of a porous magnetic particle and a magnetic carrier used in the present invention.
Figure 5B:
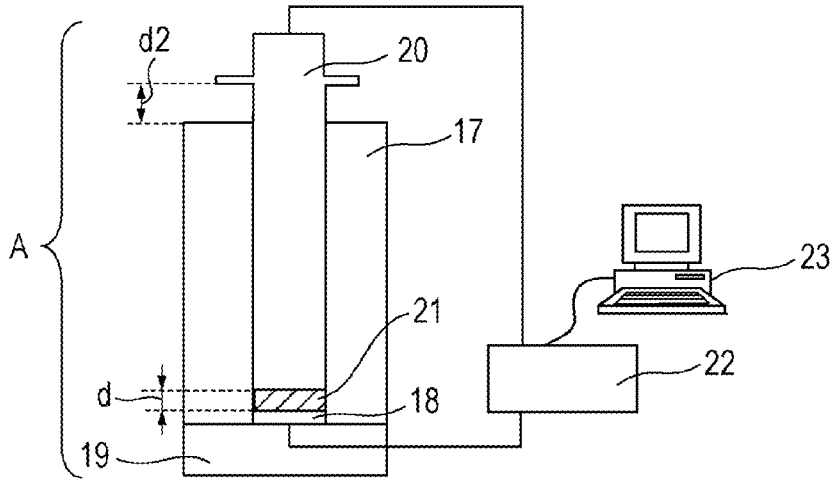

An electrical resistance measurement cell A includes a cylindrical container (made of a PTFE resin) 17 having an opening having a cross-sectional area of 2.4 $cm^2$, a lower electrode (made of stainless steel) 18, a supporting base (made of a PTFE resin) 19, and an upper electrode (made of stainless steel) 20. The cylindrical container 17 disposed on the supporting base 19 is filled with a sample (magnetic carrier or carrier core) 21 having a thickness of approximately 1 mm. After the upper electrode 20 is placed on the sample 21, the thickness of the sample 21 is measured. The thickness d of the sample 21 is calculated from the gap d1 in the absence of the sample 21 as illustrated in FIG. 5A and the gap d2 in the presence of the sample 21 having a thickness of approximately 1 mm as illustrated in FIG. 5B using the following equation.

$$d = d2 - d1 \text{ (mm)}$$

The sample mass is changed such that the sample 21 has a thickness d of 0.95 mm or more and 1.04 mm or less.

The specific resistance of the sample 21 can be determined by applying a direct-current voltage between the electrodes and measuring the electric current. An electrometer 22 (Keithley 6517A manufactured by Keithley Instruments, Inc.) and a control processing computer 23 are used.

The control processing computer includes a control system manufactured by National Instruments Corp. and control software (LabVIEW manufactured by National Instruments Corp.)

The input data include the contact area S between the sample 21 and the electrodes (2.4 $cm^2$), the measured thickness d of the sample 21 in the range of 0.95 mm or more and 1.04 mm or less, the upper electrode weight of 270 g, and the maximum applied voltage of 1000 V.

$$\text{Specific resistance } (\Omega\cdot\text{cm}) = (\text{applied voltage (V)}/\text{measured current } (A)) \times S\ (\text{cm}^2)/d\ (\text{cm})$$

$$\text{Electric field strength (V/cm)} = \text{applied voltage (V)}/d\ (\text{cm})$$

The specific resistance of the magnetic carrier or carrier core at the electric field strength is read from a graph.

<Method for Measuring 50% Particle Diameter (D50) of Magnetic Carrier and Porous Magnetic Core on Volume Basis>

The particle size distribution is measured with a laser diffraction/scattering particle size distribution analyzer "Microtrac MT3300EX" (manufactured by Nikkiso Co., Ltd.).

The 50% particle diameter (D50) of a magnetic carrier and a carrier core on a volume basis is measured with a sample feeder for dry measurement "One-shot dry sample conditioner Turbotrac" (manufactured by Nikkiso Co., Ltd.). The feed conditions for Turbotrac include the use of a dust collector as a vacuum source, an air volume of approximately 33 L/s, and a pressure of approximately 17 kPa. Turbotrac is automatically controlled using software. The particle diameter is the 50% particle diameter (D50) based on the particle size distribution on a volume basis. Control and analysis are performed with associated software (version 10.3.3-202D). The measurement conditions are as follows:

SetZero time: 10 seconds
Measurement time: 10 seconds
Number of measurements: 1
Particle refractive index: 1.81%
Particle shape: Nonspherical
Maximum particle diameter: 1408 μm
Minimum particle diameter: 0.243 μm
Measurement environment: 23° C., 50% RH <Measurement of Pore Diameter and Pore Volume of Porous Magnetic Particle>

The pore diameter distribution of a porous magnetic particle is measured using a mercury intrusion method.

The measurement principle is described below.

The amount of mercury in pores is measured while the pressure applied to the mercury is changed. The relationship between the applied pressure P and the diameter D of a pore into which mercury will intrude is given by $PD = -4\sigma(\cos\theta)$ based on the equilibrium of forces, wherein σ denotes the surface tension of the mercury and θ denotes the contact angle between mercury and the pore wall. When the contact angle θ and the surface tension σ are fixed, the diameter D of a pore into which mercury will intrude is inversely proportional to the pressure P. In a P-V curve obtained by monitoring the mercury volume V intruded as a function of pressure P, the horizontal axis P is converted into the pore diameter D using the equation to determine the pore distribution.

The measuring apparatus may be a PoreMaster series or PoreMaster-GT series fully-automatic multifunctional mercury porosimeter manufactured by Yuasa Ionics Co., Ltd. or an AutoPore IV 9500 series automated porosimeter manufactured by Shimadzu Corp.

More specifically, measurement is performed with AutoPore IV 9520 manufactured by Shimadzu Corp. using the following procedure under the following conditions.

| Measurement conditions | |
|---|---|
| Measurement environment | 20 ° C. |
| Measurement cell | Sample volume 5 $cm^3$, Intrusion volume 1.1 $cm^3$, used for powder |
| Measurement range | 2.0 psia (13.8 kPa) or more and 59989.6 psia (413.7 kPa) or less |
| Measurement step | 80 steps (at evenly spaced intervals on the logarithmic pore diameter) |
| **Intrusion parameter** | |
| Vacuum pressure | 50 μmHg |
| Evacuation time | 5.0 min |
| Mercury intrusion pressure | 2.0 psia (13.8 kPa) |
| Equilibration time | 5 seconds |
| High pressure parameter equilibration time | 5 seconds |
| Mercury parameter advancing contact angle | 130.0 degrees |
| Receding contact angle | 130.0 degrees |
| Surface tension | 485.0 mN/m (485.0 dyn/cm) |
| Mercury density | 13.5335 g/mL |

Measurement Procedure (1) Weigh approximately 1.0 g of porous magnetic cores, and charge the porous magnetic cores into a sample cell. Input the weight of the porous magnetic cores.

(2) Measurement at a low pressure in the range of 2.0 psia (13.8 kPa) or more and 45.8 psia (315.6 kPa) or less.

(3) Measurement at a high pressure in the range of 45.9 psia (316.3 kPa) or more and 59989.6 psia (413.6 kPa) or less.

(4) Calculate the pore diameter distribution from the mercury intrusion pressure and the intruded mercury volume.

(2), (3), and (4) are automatically measured using associated software.

A peak pore diameter, which provides the maximum differential pore volume in the pore diameter range of 0.1 μm or more and 3.0 μm or less, is determined from the pore diameter distribution.

The pore volume is calculated by integrating the differential pore volumes from a pore diameter of 0.1 μm to 3.0 μm using associated software.

<Measurement of Electric Current>

Figure 6:
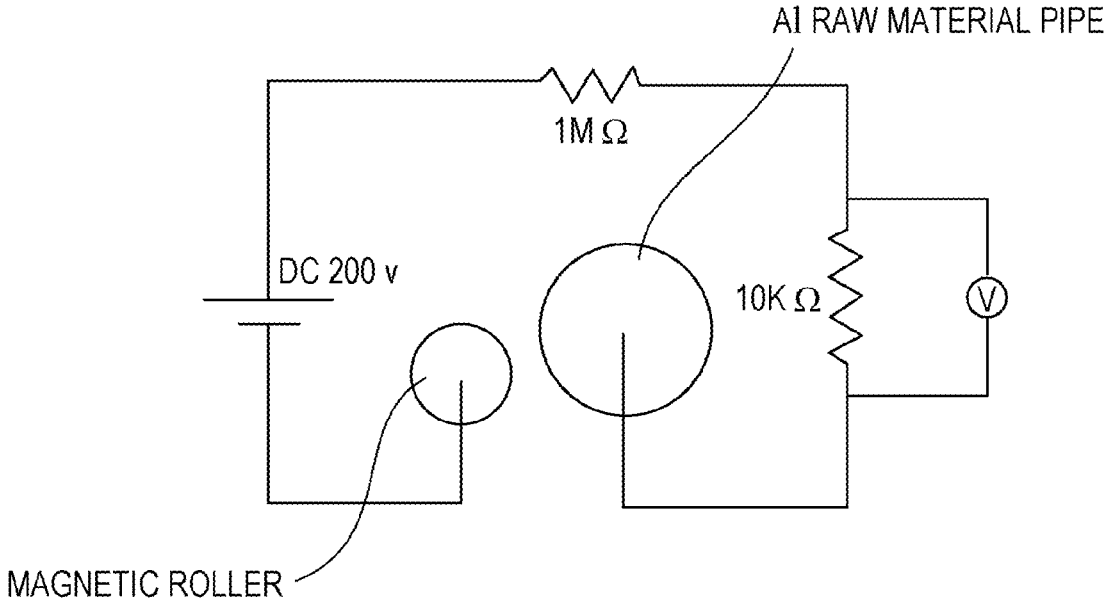
FIG. 6 is a schematic view of an apparatus for measuring the electric current of a magnetic carrier used in the present invention.

800 g of a magnetic carrier is left standing at a temperature in the range of 20° C. to 26° C. and at a humidity of 50% to 60% RH for 15 minutes or more. The electric current is measured at an applied voltage of 500 V with an electric current measuring apparatus illustrated in FIG. 6, which includes a magnetic roller and an Al raw material pipe as electrodes. The distance between the magnetic roller and the Al raw material pipe is 4.5 mm.

<Measurement of Resin Abundance Ratio in Cross Section of Magnetic Carrier>

1. Formation of Cross Section

A cross section of a magnetic carrier is processed using a focused ion beam (FIB) system FB-2100 (manufactured by Hitachi High-Technologies Corp.). A sample is prepared by applying a carbon paste to a FIB sample stage (metal mesh), fixing a small amount of magnetic carrier to the carbon paste such that particles are separated from each other, and forming an electrically conductive film by platinum vapor deposition. The sample mounted in the FIB system is roughly processed at an accelerating voltage of 40 kV using a Ga ion source (beam current 39 nA) and is then subjected to finish processing (beam current 7 nA). Thus, a carrier cross section sample is formed.

The carrier cross section sample satisfies $D50\times 0.9\leq H\leq D50\times 1.1$, wherein D50 denotes the 50% particle diameter of the carrier on a volume basis, and H denotes the length of a line segment having a maximum length in the carrier cross section. A hundred of carrier cross section samples are prepared.

2. Analysis of Magnetic Component and Resin Component of Magnetic Carrier

The elements of a magnetic component and a resin component of the magnetic carrier cross section sample are analyzed with an elemental analyzer (an energy dispersive X-ray spectrometer manufactured by EDAX Inc.) mounted on a scanning electron microscope (S4700 (trade name) manufactured by Hitachi, Ltd.).

The elements of the magnetic component are identified in a region only consisting of the magnetic component at an observation magnification of 10,000 or more, at an accelerating voltage of 20 kV, and at a capturing time of 100 seconds. In the same manner, the elements of the resin component are identified.

Since oxygen is contained in both the magnetic component and the resin component, and it is difficult to determine the oxygen content, oxygen is excluded from the resin component. Since the energy dispersive X-ray spectrometer cannot identify hydrogen, hydrogen is also excluded from the resin component. Thus, the element of the resin component of an acrylic resin composed of carbon, hydrogen, and oxygen is carbon. The elements of the resin component of a silicone resin are carbon and silicon.

3. Measurement of Resin Abundance Ratio in Cross Section

The magnetic carrier cross section is observed with the scanning electron microscope at a magnification of 2000.

In the measurement of the resin abundance ratio, a region to be measured is determined as follows:

(1) Draw a line segment having a maximum length in a cross section image.

(2) Draw two straight lines A and B parallel to the line segment and separated from the line segment by 2.5 μm.

(3) Draw a straight line C that passes through a point of contact between the line segment and a surface of a resin-filled magnetic core particle and is perpendicular to the line segment.

(4) Draw a straight line D that is parallel to the straight line C, is closer to the center of the magnetic carrier than the straight line C, and is separated from the straight line C by 5.0 μm.

(5) A region surrounded by the straight lines A, B, and D and the circumference of the resin-filled magnetic core particle is referred to as "R1".

Draw a straight line E that is parallel to the straight line D, is closer to the center of the magnetic carrier than the straight line D, and is separated from the straight line D by 5.0 μm. A region surrounded by the straight lines A, B, D, and E is referred to as "R2".

The mass ratio (mass %) of the elements in the regions R1 and R2 are determined with an elemental analyzer at an accelerating voltage of 20 kV and at a capturing time of 100 seconds.

For example, the elements of the resin component of a magnetic carrier filled with a silicone resin and coated with an acrylic resin are carbon and silicon. The total of the mass percentages (mass %) of carbon and silicon in the region R1 is referred to as JR1, and the total of the mass percentages (mass %) of carbon and silicon in the region R2 is referred to as JR2.

The JR2/JR1 ratios are calculated for the 100 particles. The average JR2/JR1 ratio of 80 particles excluding 10 particles having highest JR2/JR1 ratios and 10 particles having lowest JR2/JR1 ratios is considered to be the resin abundance ratio of the magnetic carrier cross section.

<Method for Measuring Weight-Average Particle Diameter (D4) and Number-Average Particle Diameter (D1)>

The weight-average particle diameter (D4) and the number-average particle diameter (D1) of toner are measured with an accurate particle size distribution analyzer "Coulter Counter Multisizer 3" (registered trademark, manufactured by Beckman Coulter, Inc.) equipped with a 100 μm aperture tube using an aperture impedance method and associated dedicated software "Beckman Coulter Multisizer 3 Version 3.51" (available from Beckman Coulter, Inc.) for measurement condition setting and measured data analysis. The number of effective measuring channels is 25,000. The measured data are analyzed to determine the weight-average particle diameter (D4) and the number-average particle diameter (D1) of toner.

An aqueous electrolyte used in the measurement may be approximately 1 mass % special grade sodium chloride dissolved in ion-exchanged water, for example, "ISOTON II" (manufactured by Beckman Coulter, Inc.).

Before the measurement and analysis, the dedicated software is set up as described below.

On the "Standard operation mode (SOM) setting" screen of the dedicated software, the total count number in control mode is set at 50,000 particles, the number of measurements is set at 1, and the Kd value is obtained using "standard particles 10.0 μm" (manufactured by Beckman Coulter, Inc.). A threshold/noise level measurement button is pushed to automatically set the threshold and noise level. The current is set at 1600 μA. The gain is set at 2. Isoton II is selected as an electrolyte solution. "Flushing of aperture tube after measurement" is checked.

On the "Conversion of pulse into particle size" setting screen of the dedicated software, the bin interval is set at logarithmic particle size, the particle size bin is set at 256 particle size bin, and the particle size range is set at 2 to 60 μm.

The specific measurement method is as follows:

(1) A 250-mL round bottom glass beaker for Multisizer 3 is charged with approximately 200 mL of the aqueous electrolyte and is placed on a sample stand. A stirrer rod is rotated counterclockwise at 24 revolutions per second. Soiling and air bubbles in the aperture tube are removed using the function of "Aperture flushing" of the analysis software.

(2) A 100-mL flat bottom glass beaker is charged with approximately 30 mL of the aqueous electrolyte. To the aqueous electrolyte is added approximately 0.3 mL of a dispersant "Contaminon N" (a 10 mass % aqueous neutral detergent for cleaning an accurate measuring instrument composed of a nonionic surfactant, an anionic surfactant, and an organic builder, pH 7, manufactured by Wako Pure Chemical Industries, Ltd.) diluted 3-fold by mass with ion-exchanged water.

(3) A predetermined amount of ion-exchanged water is poured into a water tank of an ultrasonic disperser "Ultrasonic Dispersion System Tetora 150" (manufactured by Nikkaki-Bios Co., Ltd.). The ultrasonic disperser includes two oscillators having an oscillation frequency of 50 kHz and has an electrical output of 120 W. The two oscillators have a phase difference of 180 degrees. Approximately 2 mL of Contaminon N is added to the ion-exchanged water.

(4) The beaker prepared in (2) is placed in a beaker-holding hole in the ultrasonic disperser, and the ultrasonic disperser is actuated. The vertical position of the beaker is adjusted such that the surface resonance of the aqueous electrolyte in the beaker is highest.

(5) While the aqueous electrolyte in the beaker prepared in (4) is exposed to ultrasonic waves, approximately 10 mg of toner is added little by little to the aqueous electrolyte and is dispersed. The ultrasonic dispersion treatment is continued for another 60 seconds. During the ultrasonic dispersion, the water temperature of the water tank is controlled at 10° C. or more and 40° C. or less.

(6) The aqueous electrolyte containing dispersed toner prepared in (5) is added dropwise with a pipette into the round bottom beaker prepared in (1) placed on the sample stand such that the measurement concentration is approximately 5%. Measurement is continued until the number of measured particles reaches 50,000.

(7) The measured data are analyzed using the associated dedicated software to determine the weight-average particle diameter (D4) and the number-average particle diameter (D1). The weight-average particle diameter (D4) is the "Average diameter" on an analysis/volume statistics (arithmetic mean) screen in the setting of graph/volume percentage in the dedicated software. The number-average particle diameter (D1) is the "Average diameter" on an analysis/number statistics (arithmetic mean) screen in the setting of graph/number percentage in the dedicated software.

<Method for Calculating Amount of Fine Powder>

The amount of fine powder on a number basis (number percentage) in a toner is calculated as described below.

For example, after the measurement with the Multisizer 3, the number percentage of particles of 4.0 μm or less in a toner is determined as follows: (1) Select graph/number percentage in the dedicated software to display a chart of measurements on a number percentage basis. (2) Check "<" in a particle size setting on a format/particle size/particle size statistics screen, and input "4" in a particle size input section below the "<". (3) The value in the item "<4 μm" on an analysis/number statistics (arithmetic mean) screen is the number percentage of particles of 4.0 μm or less in the toner.

<Method for Calculating Amount of Coarse Powder>

The amount of coarse powder on a volume basis (volume percentage) in a toner is calculated as described below.

For example, after the measurement with the Multisizer 3, the volume percentage of particles of 10.0 μm or more in a toner is determined as follows: (1) Select graph/volume percentage in the dedicated software to display a chart of measurements on a volume percentage basis. (2) Check ">" in a particle size setting on a format/particle size/particle size statistics screen, and input "10" in a particle size input section below the ">". (3) The value in the item ">10 μm" on an analysis/volume statistics (arithmetic mean) screen is the volume percentage of particles of 10.0 μm or less in the toner.

EXAMPLES

Although the present invention will be more specifically described in the following examples, the present invention is not limited to these examples.

<Production Example of Porous Magnetic Particles 1>

Step 1 (Weighing and Mixing Step)

| | |
|---|---|
| $Fe_2O_3$ | 68.3 mass % |
| $MnCO_3$ | 28.5 mass % |
| $Mg(OH)_2$ | 2.0 mass % |
| $SrCO_3$ | 1.2 mass % |

These ferrite raw materials were weighed. 80 parts by mass of the ferrite raw materials and 20 parts by mass of water were wet-blended in a ball mill using zirconia balls having a diameter (ϕ) of 10 mm for 3 hours to prepare a slurry. The solid content of the slurry was 80 mass %.

Step 2 (Calcination Step)

The slurry was dried in a spray dryer (manufactured by Ohkawara Kakohki Co., Ltd.) and was calcined in a batch type electric furnace in a nitrogen atmosphere (oxygen concentration 1.0% by volume) at a temperature of 1050° C. for 3.0 hours to produce calcined ferrite.

Step 3 (Pulverization Step)

The calcined ferrite was pulverized into approximately 0.5 mm with a crusher. Water was added to the pulverized calcined ferrite to prepare a slurry. The solid content of the slurry was 70 mass %. The slurry was pulverized in a wet ball mill using ⅛-inch stainless steel beads for 3 hours to produce a slurry. The slurry was pulverized in a wet bead mill using zirconia beads having a diameter of 1 mm for 4 hours to produce a calcined ferrite slurry having a 50% particle diameter (D50) of 1.3 μm on a volume basis.

Step 4 (Granulation Step)

100 parts by mass of the calcined ferrite slurry mixed with 1.0 part by mass of an ammonium polycarboxylate dispersant and 1.5 parts by mass of a poly(vinyl alcohol) binder was granulated in a spray dryer (manufactured by Ohkawara Kakohki Co., Ltd.) and was dried. The granulated particles were subjected to particle size adjustments and were heated in a rotary electric furnace at 700° C. for 2 hours to remove organic substances, such as the dispersant and the binder.

Step 5 (Firing Step)

The granulated particles were heated in a nitrogen atmosphere (oxygen concentration 1.0% by volume) from room temperature to the firing temperature (1100° C.) over two hours and were fired at a temperature of 1100° C. for 4 hours. The particles were cooled to 60° C. over 8 hours. The atmosphere was changed from nitrogen to the air. The particles were removed at a temperature of 40° C. or less.

Step 6 (Separation Step)

Aggregated particles were crushed and were passed through a sieve having openings of 150 μm to remove coarse particles, were air-classified to remove fine particles, and were subjected to magnetic separation to remove a low magnetic energy product, thus yielding porous magnetic particles 1. The porous magnetic particles 1 had pores. Table 1 shows the conditions for each production step of the porous magnetic particles 1. Table 2 shows the physical properties of the porous magnetic particles 1.

<Production Example of Porous Magnetic Particles 2 to 18 and Magnetic Core 1>

Porous magnetic particles 2 to 18 and a magnetic core 1 were produced in the same manner as in the production example of the porous magnetic particles 1 except that the conditions for each production step were changed as shown in Table 1. Table 1 shows the conditions for each production step of the porous magnetic particles 2 to 18 and the magnetic core 1. Table 2 shows the physical properties of the porous magnetic particles 2 to 18 and the magnetic core 1.

TABLE 2-continued

| Porous magnetic particle No. | D50 (μm) | Specific resistance at 300 V/cm (Ω · cm) | Mercury intrusion method: Peak pore diameter (μm) | Mercury intrusion method: Pore volume ($mm^3/g$) |
|---|---|---|---|---|
| 4 | 45.0 | $2.1 \times 10^7$ | 0.61 | 50 |
| 5 | 60.5 | $8.1 \times 10^8$ | 0.76 | 80 |
| 6 | 34.2 | $1.9 \times 10^7$ | 0.51 | 20 |
| 7 | 65.8 | $8.7 \times 10^8$ | 0.88 | 100 |
| 8 | 35.4 | $1.9 \times 10^7$ | 0.49 | 19 |
| 9 | 75.2 | $9.0 \times 10^8$ | 0.90 | 101 |
| 10 | 33.6 | $9.6 \times 10^6$ | 0.40 | 18 |
| 11 | 76.0 | $1.6 \times 10^9$ | 1.00 | 102 |
| 12 | 33.1 | $9.1 \times 10^6$ | 0.39 | 22 |
| 13 | 76.8 | $2.0 \times 10^9$ | 1.01 | 99 |
| 14 | 38.0 | $8.5 \times 10^6$ | 0.65 | 69 |
| 15 | 45.0 | $5.3 \times 10^8$ | 1.10 | 75 |
| 16 | 41.0 | $8.5 \times 10^6$ | 1.30 | 98 |
| 17 | 39.4 | $4.5 \times 10^6$ | 0.92 | 105 |
| 18 | 42.9 | $9.0 \times 10^9$ | 0.35 | 16 |
| Magnetic core 1 | 53.6 | $7.7 \times 10^7$ | — | — |

<Production Example of Magnetic Carriers 1 to 30>

Step 1 (Filling step)

100 parts by mass of the porous magnetic particles 1 were held at a temperature of 60° C. in a mixing vessel of a mixer (an NDMV versatile mixer manufactured by Dalton Corp.). Nitrogen was introduced into the mixing vessel at a reduced pressure of 2.3 kPa. A resin solution 1 shown in Table 3 was added dropwise to the porous magnetic particles 1. The amount of resin solution 1 was adjusted such that the resin component solid content was 5.0 parts by mass per 100 parts by mass of the porous magnetic particles 1.

After the dropwise addition, the porous magnetic particles 1 were agitated for 2.5 hours and were then heated to 70° C. under reduced pressure to remove the solvent. The vacancies of the porous magnetic particles 1 were filled with a resin composition.

TABLE 1

| Porous magnetic particle No. | Step 2 Calcination step: Temperature (° C.) | Step 2 Calcination step: Time (h) | Step 3 Pulverization step: Wet ball mill pulverization time (h) | Step 3 Pulverization step: Wet bead mill pulverization time (h) | Step 3 Pulverization step: D50 (μm) | Step 4 Granulation step: Organic substance removal temperature (° C.) | Step 5 Firing step: Firing Apparatus [electric furnace] | Step 5 Firing step: Oxygen concentration (vol %) | Step 5 Firing step: Firing temperature (° C.) | Step 5 Firing step: heat-up time (h) | Step 5 Firing step: Holding time (h) | Step 6 Separation step: Opening (μm) |
|---|---|---|---|---|---|---|---|---|---|---|---|---|
| 1 | 1050 | 3.0 | 3.0 | 4.0 | 1.3 | 700 | Tunnel type | 1.0 | 1100 | 2.0 | 4.0 | 150 |
| 2 | 1050 | 3.0 | 3.0 | 4.0 | 1.3 | 700 | Tunnel type | 0.8 | 1100 | 2.0 | 4.0 | 150 |
| 3 | 1050 | 3.0 | 3.0 | 4.0 | 1.3 | 700 | Tunnel type | 1.1 | 1100 | 2.0 | 4.0 | 150 |
| 4 | 1050 | 3.0 | 3.0 | 5.0 | 1.2 | 700 | Tunnel type | 0.8 | 1130 | 2.0 | 4.0 | 150 |
| 5 | 1050 | 2.0 | 3.0 | 3.0 | 1.5 | 700 | Tunnel type | 1.1 | 1100 | 2.3 | 3.9 | 150 |
| 6 | 1050 | 3.0 | 3.0 | 5.0 | 1.2 | 700 | Tunnel type | 0.8 | 1150 | 1.5 | 4.5 | 150 |
| 7 | 1050 | 2.0 | 2.0 | 3.0 | 2.1 | 700 | Tunnel type | 1.2 | 1020 | 2.4 | 3.8 | 150 |
| 8 | 1050 | 3.0 | 4.0 | 5.0 | 1.0 | 700 | Tunnel type | 0.8 | 1150 | 1.4 | 4.6 | 150 |
| 9 | 1000 | 2.0 | 2.0 | 2.0 | 2.5 | 650 | Tunnel type | 1.3 | 1020 | 2.5 | 4.0 | 250 |
| 10 | 1050 | 3.0 | 4.0 | 5.0 | 1.0 | 700 | Tunnel type | 0.7 | 1150 | 1.3 | 4.7 | 150 |
| 11 | 1000 | 2.0 | 2.0 | 2.0 | 2.5 | 650 | Tunnel type | 1.4 | 1020 | 2.6 | 4.0 | 250 |
| 12 | 1050 | 3.0 | 4.0 | 5.0 | 1.0 | 700 | Tunnel type | 0.7 | 1150 | 1.2 | 4.8 | 150 |
| 13 | 950 | 2.0 | 2.0 | 2.0 | 2.5 | 650 | Tunnel type | 1.4 | 1020 | 2.7 | 4.0 | 250 |
| 14 | 950 | 2.0 | 2.0 | 3.0 | 2.1 | 700 | Rotary type | 1.0 | 900 | 1.0 | 2.0 | 150 |
| 15 | 950 | 2.0 | 2.0 | 3.0 | 2.1 | 650 | Tunnel type | 1.1 | 1100 | 2.7 | 3.3 | 150 |
| 16 | 950 | 2.0 | 2.0 | 3.0 | 2.1 | 650 | Tunnel type | 0.6 | 1020 | 2.7 | 3.3 | 150 |
| 17 | 1000 | 2.0 | 2.0 | 3.0 | 2.1 | 650 | Tunnel type | 0.5 | 1020 | 2.7 | 3.3 | 150 |
| 18 | 1050 | 2.0 | 4.0 | 5.0 | 1.0 | 700 | Tunnel type | 1.5 | 1150 | 1.1 | 4.9 | 150 |
| Magnetic core 1 | 950 | 2.0 | 2.0 | 3.0 | 2.1 | 650 | Tunnel type | 1.0 | 1200 | 4.0 | 5.0 | 150 |

TABLE 2

| Porous magnetic particle No. | D50 (μm) | Specific resistance at 300 V/cm (Ω · cm) | Mercury intrusion method: Peak pore diameter (μm) | Mercury intrusion method: Pore volume ($mm^3/g$) |
|---|---|---|---|---|
| 1 | 37.7 | $2.0 \times 10^8$ | 0.65 | 65 |
| 2 | 37.2 | $3.5 \times 10^7$ | 0.70 | 64 |
| 3 | 34.9 | $7.5 \times 10^8$ | 0.71 | 61 |

After cooling, the resulting resin-filled magnetic core particles were transferred to a mixer having a spiral blade in a rotatable mixing vessel (a UD-AT drum mixer manufactured by Sugiyama Heavy Industrial Co., Ltd.) and were heated to 220° C. at a heating rate of 2° C./min in a nitrogen atmosphere. The resin-filled magnetic core particles were agitated at 220° C. for 1.0 hour to cure the resin and were then agitated at 200° C. for 1.0 hour.

The cured ferrite particles were cooled to room temperature and were removed from the mixer. Nonmagnetic substances were removed from the cured ferrite particles with a magnetic separator. Coarse particles were removed from the cured ferrite particles with a vibrating screen, thus yielding resin-filled magnetic core particles.

Step 2 (Resin Coating Step)

Subsequently, a resin solution 3 shown in Table 3 was added to the porous magnetic particles in a planetary mixer (Nauta mixer VN manufactured by Hosokawa Micron Corp.) under reduced pressure (1.5 kPa) at a temperature of 60° C. such that the resin component solid content was 2.0 parts by mass per 100 parts by mass of the porous magnetic particles. More specifically, after one third of the resin solution was added to the porous magnetic particles, solvent removal and coating were performed for 20 minutes. Subsequently, after one third of the resin solution was added to the porous magnetic particles, solvent removal and coating were performed for 20 minutes. Subsequently, after one third of the resin solution was added to the porous magnetic particles, solvent removal and coating were performed for 20 minutes.

A magnetic carrier coated with the coating resin composition was transferred to a mixer having a spiral blade in a rotatable mixing vessel (a UD-AT drum mixer manufactured by Sugiyama Heavy Industrial Co., Ltd.). The magnetic carrier was heat-treated in a nitrogen atmosphere at a temperature of 120° C. for two hours while the mixing vessel was rotated at 10 revolutions per minute. A low magnetic energy product was separated from the resulting magnetic carrier 1 by magnetic separation. The magnetic carrier 1 was passed through a sieve having openings of 150 μm and was air-classified. The magnetic carrier 1 had a 50% particle diameter (D50) of 39.5 μm based on the volume distribution.

Tables 4 and 5 show the conditions for each production step of the magnetic carrier 1. Tables 6 and 7 show the physical properties of the magnetic carrier 1.

Magnetic carriers 2 to 30 were produced under the production conditions shown in Tables 4 and 5. Tables 6 and 7 show the physical properties of the magnetic carriers 2 to 30.

The coating step of the magnetic carrier 27 was described below.

Dry Coating Step of Magnetic Carrier 27

A solvent was removed from a resin solution 2. The resulting resin solid component was pulverized into a weight-average particle diameter of 50 μm. 100 parts by mass of porous magnetic particles 14 and 2.9 parts by mass of the resin solid component were charged into a powder processor Nobilta (manufactured by Hosokawa Micron Corp.). In a premixing step, mixing was performed for 2 minutes. The peripheral speed of an outermost end of an agitation member was 1 m/s. After the peripheral speed was increased to 10 m/s, coating treatment was performed for 15 minutes, thus yielding the magnetic carrier 27. A low magnetic energy product was separated from the magnetic carrier 27 by magnetic separation. The magnetic carrier 27 was passed through a sieve having openings of 150 μm and was air-classified. The magnetic carrier 27 had a 50% particle diameter (D50) of 38.0 μm based on the volume distribution.

TABLE 3

| Resin solution No. | Resin component Type | Content (mass %) | Solvent component Type | Content (mass %) | Additive Type | Content (mass %) |
|---|---|---|---|---|---|---|
| Solution 1 | SR2410 (solid content 20%) manufactured by Dow Corning Toray Co., Ltd. | 50.0 | Toluene | 49.5 | γ-aminopropyltriethoxysilane | 0.5 |
| Solution 2 | Poly(methyl methacrylate) (solid content 40%) weight-average molecular weight (Mw): 85000 | 50.0 | Toluene | 50.0 | — | — |
| Solution 3 | Copolymer of cyclohexyl methacrylate/methyl methacrylate macromonomer (Mw 5000)/methyl methacrylate | 50.0 | Toluene | 46.0 | Melamine/formaldehyde condensate (Epostar S6 manufactured by Nippon Shokubai Co., Ltd.) | 3.0 |
| | | | | | Carbon black (#25manufactured by Mitsubishi Chemical Corp.) | 1.0 |

TABLE 4

| Carrier No. | Porous magnetic particle No. | Filling step: Resin solution | Solid content per 100 parts by mass of porous magnetic particle (parts by mass) | Agitation time after addition (h) | Agitator set temperature (° C.) | Agitation time (h) | Holding temperature (° C.) | Holding time (h) |
|---|---|---|---|---|---|---|---|---|
| 1 | 1 | 1 | 5.0 | 2.5 | 220 | 1.0 | 200 | 1.0 |
| 2 | 1 | 3 | 4.0 | 2.5 | 120 | 1.0 | 120 | 1.0 |
| 3 | 2 | 1 | 5.0 | 2.5 | 220 | 1.0 | 200 | 1.0 |
| 4 | 3 | 1 | 4.0 | 2.5 | 220 | 1.0 | 200 | 1.0 |
| 5 | 2 | 1 | 3.0 | 2.0 | 220 | 1.0 | 200 | 1.0 |
| 6 | 3 | 1 | 6.0 | 2.7 | 220 | 1.0 | 200 | 1.0 |
| 7 | 1 | 2 | 1.1 | 1.5 | 100 | 1.0 | 100 | 2.0 |
| 8 | 1 | 1 | 7.9 | 3.0 | 220 | 1.0 | 200 | 1.0 |
| 9 | 4 | 1 | 0.5 | 1.5 | 220 | 1.0 | 200 | 1.0 |
| 10 | 5 | 1 | 8.1 | 3.0 | 220 | 1.0 | 200 | 1.0 |
| 11 | 6 | 2 | 0.5 | 1.5 | 100 | 1.0 | 100 | 2.0 |
| 12 | 7 | 1 | 5.0 | 2.5 | 220 | 1.0 | 200 | 1.0 |
| 13 | 8 | 1 | 0.5 | 1.5 | 220 | 1.0 | 200 | 1.0 |
| 14 | 9 | 1 | 7.9 | 3.0 | 220 | 1.0 | 200 | 1.0 |
| 15 | 10 | 1 | 0.5 | 1.5 | 220 | 1.0 | 200 | 1.0 |
| 16 | 11 | 1 | 7.9 | 3.0 | 220 | 1.0 | 200 | 1.0 |
| 17 | 12 | 1 | 0.5 | 1.5 | 220 | 1.0 | 200 | 1.0 |
| 18 | 13 | 1 | 6.9 | 2.5 | 220 | 1.0 | 200 | 1.0 |
| 19 | 14 | 1 | 5.5 | 2.2 | 220 | 1.0 | 200 | 1.0 |
| 20 | 1 | 1 | 0.9 | 1.0 | 220 | 1.0 | 200 | 1.0 |
| 21 | 15 | 1 | 0.9 | 1.0 | 220 | 1.0 | 200 | 1.0 |
| 22 | 15 | 1 | 8.5 | 3.5 | 220 | 1.0 | 200 | 1.0 |
| 23 | 16 | 1 | 8.5 | 3.5 | 220 | 1.0 | 200 | 1.0 |
| 24 | 14 | 1 | 6.0 | 2.5 | 200 | 1.0 | 180 | 1.0 |
| 25 | 16 | 1 | 4.5 | 2.0 | 220 | 1.0 | 200 | 1.0 |
| 26 | 1 | 1 | 6.5 | 2.0 | 220 | 1.0 | 200 | 1.0 |
| 27 | 14 | — | 0.0 | — | — | — | — | — |
| 28 | 17 | 1 | 11.0 | 5.0 | 200 | 1.0 | 180 | 2.0 |
| 29 | 18 | — | 0.0 | — | — | — | — | — |
| 30 | Magnetic core 1 | — | 0.0 | — | — | — | — | — |

TABLE 5

| Carrier No. | Porous magnetic particle No. | Coating step: Resin solution | Solid content per 100 parts by mass of porous magnetic particle (parts by mass) | Coating method | Coater temperature (° C.) | Processing time (h) | Opening (μm) |
|---|---|---|---|---|---|---|---|
| 1 | 1 | 3 | 2.0 | Wet | 120 | 2.0 | 150 |
| 2 | 1 | 3 | 2.0 | Wet | 120 | 2.0 | 150 |
| 3 | 2 | 3 | 2.0 | Wet | 120 | 2.0 | 150 |
| 4 | 3 | 3 | 2.0 | Wet | 120 | 2.0 | 150 |
| 5 | 2 | 3 | 2.0 | Wet | 120 | 2.0 | 150 |
| 6 | 3 | 3 | 2.0 | Wet | 120 | 2.0 | 150 |
| 7 | 1 | 3 | 2.0 | Wet | 120 | 2.0 | 150 |
| 8 | 1 | 3 | 1.0 | Wet | 120 | 2.0 | 150 |
| 9 | 4 | 3 | 2.4 | Wet | 120 | 2.0 | 150 |
| 10 | 5 | 3 | 1.0 | Wet | 120 | 2.0 | 150 |
| 11 | 6 | 3 | 2.0 | Wet | 120 | 2.0 | 150 |
| 12 | 7 | 3 | 2.0 | Wet | 120 | 2.0 | 150 |
| 13 | 8 | 3 | 2.0 | Wet | 120 | 2.0 | 150 |
| 14 | 9 | 3 | 1.0 | Wet | 120 | 2.0 | 250 |
| 15 | 1 | 3 | 2.0 | Wet | 120 | 2.0 | 150 |
| 16 | 11 | 3 | 1.0 | Wet | 120 | 2.0 | 250 |
| 17 | 12 | 3 | 2.0 | Wet | 120 | 2.0 | 150 |
| 18 | 13 | 3 | 2.0 | Wet | 120 | 2.0 | 250 |
| 19 | 14 | 3 | 2.0 | Wet | 120 | 2.0 | 150 |
| 20 | 1 | 3 | 2.0 | Wet | 120 | 2.0 | 150 |
| 21 | 15 | 3 | 2.0 | Wet | 120 | 2.0 | 150 |
| 22 | 15 | 3 | 1.0 | Wet | 120 | 2.0 | 150 |
| 23 | 16 | 3 | 1.5 | Wet | 120 | 2.0 | 150 |
| 24 | 14 | — | 0.0 | — | — | — | 150 |
| 25 | 16 | 3 | 2.0 | Wet | 120 | 2.0 | 150 |
| 26 | 1 | 3 | 2.0 | Wet | 120 | 2.0 | 150 |
| 27 | 14 | 2 | 2.9 | Dry | — | — | 150 |
| 28 | 17 | — | 0.0 | — | — | — | 150 |

TABLE 5-continued

| | | Coating step | | | | | |
|---|---|---|---|---|---|---|---|
| Carrier No. | Porous magnetic particle No. | Resin solution | Solid content per 100 parts by mass of porous magnetic particle (parts by mass) | Coating method | Coater temperature (° C.) | Processing time (h) | Opening (μm) |
| 29 | 18 | 2 | 1.0 | Wet | 100 | 2.0 | 150 |
| 30 | Magnetic core 1 | 1 | 0.5 | Wet | 200 | 2.0 | 150 |

TABLE 6

| | | Amount of resin per 100 parts by mass of porous magnetic particle | | | | | |
|---|---|---|---|---|---|---|---|
| Carrier No. | Porous magnetic particle No. | Amount of resin filled (parts by mass) | Amount of resin coated (parts by mass) | Total amount of resin (parts by mass) | D50 (μm) | Specific resistance at 2000 V/cm (Ω · cm) | Electric current (μA) |
| 1 | 1 | 5.0 | 2.0 | 7.0 | 39.1 | $2.3 \times 10^{8}$ | 28.5 |
| 2 | 1 | 4.0 | 2.0 | 6.0 | 41.6 | $7.8 \times 10^{8}$ | 17.2 |
| 3 | 2 | 5.0 | 2.0 | 7.0 | 38.3 | $9.5 \times 10^{7}$ | 29.7 |
| 4 | 3 | 4.0 | 2.0 | 6.0 | 35.2 | $8.6 \times 10^{8}$ | 27.6 |
| 5 | 2 | 3.0 | 2.0 | 5.0 | 38.9 | $3.6 \times 10^{7}$ | 32.0 |
| 6 | 3 | 6.0 | 2.0 | 8.0 | 35.9 | $4.6 \times 10^{9}$ | 21.6 |
| 7 | 1 | 1.1 | 2.0 | 3.1 | 38.1 | $2.3 \times 10^{7}$ | 48.8 |
| 8 | 1 | 7.9 | 1.0 | 8.9 | 41.6 | $6.5 \times 10^{9}$ | 8.3 |
| 9 | 4 | 0.5 | 2.4 | 2.9 | 47.7 | $5.7 \times 10^{8}$ | 14.2 |
| 10 | 5 | 8.1 | 1.0 | 9.1 | 62.3 | $3.5 \times 10^{9}$ | 36.9 |
| 11 | 6 | 0.5 | 2.0 | 2.5 | 34.9 | $3.6 \times 10^{9}$ | 12.9 |
| 12 | 7 | 5.0 | 2.0 | 7.0 | 66.6 | $9.7 \times 10^{8}$ | 39.8 |
| 13 | 8 | 0.5 | 2.0 | 2.5 | 36.1 | $3.6 \times 10^{9}$ | 12.5 |
| 14 | 9 | 7.9 | 1.0 | 8.9 | 76.4 | $9.7 \times 10^{8}$ | 40.4 |
| 15 | 1 | 0.5 | 2.0 | 2.5 | 34.0 | $5.3 \times 10^{9}$ | 10.2 |
| 16 | 11 | 7.9 | 1.0 | 8.9 | 76.8 | $2.0 \times 10^{9}$ | 42.9 |
| 17 | 12 | 0.5 | 2.0 | 2.5 | 33.7 | $5.3 \times 10^{9}$ | 8.1 |
| 18 | 13 | 6.9 | 2.0 | 8.9 | 77.2 | $8.0 \times 10^{9}$ | 49.9 |
| 19 | 14 | 5.5 | 2.0 | 7.5 | 40.6 | $7.5 \times 10^{6}$ | 48.9 |
| 20 | 1 | 0.9 | 2.0 | 2.9 | 38.3 | $2.1 \times 10^{8}$ | 39.9 |
| 21 | 15 | 0.9 | 2.0 | 2.9 | 47.1 | $6.0 \times 10^{8}$ | 45.2 |
| 22 | 15 | 8.5 | 1.0 | 9.5 | 49.6 | $8.0 \times 10^{9}$ | 11.5 |
| 23 | 16 | 8.5 | 1.5 | 10.0 | 44.2 | $8.2 \times 10^{7}$ | 40.3 |
| 24 | 14 | 6.0 | 0.0 | 6.0 | 40.7 | $2.8 \times 10^{7}$ | 60.5 |
| 25 | 16 | 4.5 | 2.0 | 6.5 | 42.9 | $9.8 \times 10^{6}$ | 64.1 |
| 26 | 1 | 6.5 | 2.0 | 8.5 | 39.9 | $1.8 \times 10^{10}$ | 7.8 |
| 27 | 14 | 0.0 | 2.9 | 2.9 | 40.9 | $4.3 \times 10^{10}$ | 5.8 |
| 28 | 17 | 11.0 | 0.0 | 11.0 | 45.8 | $8.6 \times 10^{7}$ | 53.9 |
| 29 | 18 | 0.0 | 1.0 | 1.0 | 43.1 | $9.6 \times 10^{9}$ | 7.6 |
| 30 | Magnetic core 1 | 0.0 | 0.5 | 0.5 | 54.3 | $8.6 \times 10^{7}$ | 40.2 |

TABLE 7

| | Resin abundance ratio in cross section | | | | | | |
|---|---|---|---|---|---|---|---|
| | Resin component in R1 | | | Resin component in R2 | | | |
| Carrier No. | Carbon component (mass %) | Silicon component (mass %) | JR1 | Carbon component (mass %) | Silicon component (mass %) | JR2 | JR2/JR1 |
| 1 | 2.19 | 3.09 | 5.28 | 2.35 | 6.35 | 8.70 | 1.65 |
| 2 | 5.10 | — | 5.10 | 7.25 | — | 7.25 | 1.42 |
| 3 | 1.95 | 3.29 | 5.24 | 2.21 | 6.48 | 8.69 | 1.66 |
| 4 | 2.07 | 3.56 | 5.63 | 1.96 | 5.94 | 7.90 | 1.40 |
| 5 | 2.03 | 3.62 | 5.65 | 1.87 | 5.86 | 7.73 | 1.37 |
| 6 | 2.14 | 3.49 | 5.63 | 2.63 | 6.93 | 9.56 | 1.70 |
| 7 | 2.50 | — | 2.50 | 4.78 | — | 4.78 | 1.91 |
| 8 | 2.11 | 6.24 | 8.35 | 2.97 | 7.32 | 10.29 | 1.23 |
| 9 | 0.94 | 2.17 | 3.11 | 1.74 | 4.15 | 5.89 | 1.89 |
| 10 | 1.81 | 4.74 | 6.55 | 3.13 | 7.92 | 11.05 | 1.69 |
| 11 | 2.61 | — | 2.61 | 3.53 | — | 3.53 | 1.35 |
| 12 | 1.99 | 2.98 | 4.97 | 2.39 | 6.22 | 8.61 | 1.73 |

TABLE 7-continued

| Carrier No. | Resin abundance ratio in cross section: Resin component in R1: Carbon component (mass %) | Resin component in R1: Silicon component (mass %) | JR1 | Resin component in R2: Carbon component (mass %) | Resin component in R2: Silicon component (mass %) | JR2 | JR2/JR1 |
|---|---|---|---|---|---|---|---|
| 13 | 1.47 | 2.09 | 3.56 | 1.11 | 3.53 | 4.64 | 1.30 |
| 14 | 1.96 | 4.73 | 6.69 | 3.14 | 8.64 | 11.78 | 1.76 |
| 15 | 1.63 | 2.14 | 3.77 | 1.15 | 3.56 | 4.71 | 1.25 |
| 16 | 1.74 | 4.60 | 6.34 | 3.16 | 8.70 | 11.86 | 1.87 |
| 17 | 1.74 | 2.08 | 3.82 | 1.11 | 3.53 | 4.64 | 1.21 |
| 18 | 1.54 | 4.19 | 5.73 | 3.03 | 8.31 | 11.34 | 1.98 |
| 19 | 2.35 | 3.45 | 5.80 | 2.37 | 6.41 | 8.78 | 1.51 |
| 20 | 1.24 | 1.77 | 3.01 | 1.89 | 4.19 | 6.08 | 2.02 |
| 21 | 1.22 | 1.71 | 2.93 | 1.92 | 4.23 | 6.15 | 2.10 |
| 22 | 2.51 | 5.88 | 8.39 | 3.36 | 6.53 | 9.89 | 1.18 |
| 23 | 2.89 | 5.82 | 8.71 | 3.41 | 6.62 | 10.03 | 1.15 |
| 24 | 0.97 | 3.24 | 4.21 | 2.08 | 5.74 | 7.82 | 1.86 |
| 25 | 1.96 | 2.51 | 4.47 | 2.53 | 6.45 | 8.98 | 2.01 |
| 26 | 2.87 | 5.09 | 7.96 | 2.97 | 6.03 | 9.00 | 1.13 |
| 27 | 2.08 | — | 2.08 | 2.19 | — | 2.19 | 1.05 |
| 28 | 1.56 | 8.92 | 10.48 | 1.83 | 10.16 | 11.99 | 1.14 |
| 29 | 0.68 | — | 0.68 | 1.38 | — | 1.39 | 2.04 |
| 30 | 0.21 | 0.84 | 1.05 | — | — | — | 0 |

[Production Example of Toner 1]

| | |
|---|---|
| Binder resin (a polyester resin having Tg of 58° C., an acid value of 15 mgKOH/g, a hydroxyl value of 15 mgKOH/g, a peak molecular weight of 5800, a number-average molecular weight of 3500, and a weight-average molecular weight of 95000) | 100 parts by mass |
| C.I. Pigment Blue 15:3 | 4.5 parts by mass |
| aluminum 3,5-di-t-butyl salicylate compound | 0.5 parts by mass |
| Normal paraffin wax (melting point: 78° C.) | 6.0 parts by mass |

These materials were sufficiently mixed in a Henschel mixer (FM-75J manufactured by Mitsui Mining Co., Ltd.) and were kneaded in a twin-screw kneader (PCM-30 manufactured by Ikegai Corp.) at a temperature of 130° C. and at a feed rate of 10 kg/h (the discharge temperature was approximately 150° C.). The kneaded product was cooled, was crushed in a hammer mill, and was pulverized in a mechanical pulverizer (T-250 manufactured by Turbo Kogyo Co., Ltd.) at a feed rate of 15 kg/h. The resulting particles had a weight-average particle diameter of 5.5 μm. Particles having a particle diameter of 4.0 μm or less constituted 55.6% by number of all the particles. Particles having a particle diameter of 10.0 μm or more constituted 0.8% by volume of all the particles.

A fine powder and a coarse powder were removed from the particles with a rotary classifier (TTSP100 manufactured by Hosokawa Micron Corp.). The resulting cyan toner particles 1 had a weight-average particle diameter of 6.4 μm. The abundance of particles having a particle diameter of 4.0 μm or less was 25.8% by number. Particles having a particle diameter of 10.0 μm or more constituted 2.5% by volume of the cyan toner particles 1.

The following materials were mixed in a Henschel mixer (FM-75 manufactured by Nippon Coke & Engineering Co., Ltd.) for 3 minutes. The peripheral speed of the rotor blade was 35.0 m/s. Silica and titanium oxide were deposited on the cyan toner particles 1, thus yielding a cyan toner 1.

| | |
|---|---|
| Cyan toner particles 1 | 100 parts by mass |
| Silica | 3.5 parts by mass |

(This silica was prepared by treating the surface of silica fine particles produced using a sol-gel process with 1.5 mass % hexamethyldisilazane and classifying the silica fine particles into particles having a desired particle size distribution. Number average particle diameter: 110 nm.)

| | |
|---|---|
| Titanium oxide | 0.5 parts by mass |

(This titanium oxide was prepared by treating the surface of anatase crystalline metatitanic acid with an octylsilane compound. Number average particle diameter: 40 nm.)

Yellow toner particles 1, magenta toner particles 1, and black toner particles 1 were produced in the same manner as in the cyan toner particles 1 except that 4.5 parts by mass of C.I. Pigment Blue 15:3 was replaced by 7.0 parts by mass of C.I. Pigment Yellow 74, 6.3 parts by mass of C.I. Pigment Red 122, and 5.0 parts by mass of carbon black, respectively.

A yellow toner 1, a magenta toner 1, and a black toner 1 were produced by the addition of silica and titanium oxide in the same manner as in the cyan toner 1.

Table 8 shows the physical properties of these toners.

TABLE 8

| | Toner particle diameter: Weight-average particle diameter (μm) | Abundance of particles having particle diameter of 4.0 μm or less (%) | Abundance of particles having particle diameter of 10.0 μm or more (%) |
|---|---|---|---|
| Cyan toner 1 | 6.4 | 25.8 | 2.5 |
| Yellow toner 1 | 6.3 | 26.2 | 2.4 |
| Magenta toner 1 | 6.3 | 25.9 | 2.5 |
| Black toner 1 | 6.7 | 24.6 | 2.6 |

Example 1

300 g of a two-component developer was prepared by adding 9 parts by mass of a color toner 1 to 91 parts by mass of a magnetic carrier 1 and shaking the mixture in a shaker (YS-8D manufactured by Yayoi Co., Ltd.). The shaker was operated at 200 rpm for 2 minutes.

A developer for replenishment was prepared by mixing 10 parts by mass of the magnetic carrier 1 and 90 parts by mass of the toner 1 at normal temperature and at a humidity of 23° C./50% RH in a V-type mixer for 5 minutes.

The following evaluation was performed using the two-component developer and the developer for replenishment.

A modified machine of a color copying machine image RUNNER ADVANCE C9075 PRO manufactured by CANON KABUSHIKI KAISHA was used as an image-forming apparatus.

The two-component developers of various colors were charged into their corresponding developing units of the image-forming apparatus. Containers of developers for replenishment of the colors were mounted on the image-forming apparatus.

Evaluation was performed at a temperature of 23° C. and at a humidity of 5% RH (hereinafter referred to as "N/L") or at a temperature of 30° C. and at a humidity of 80% RH (hereinafter referred to as "H/H"). An FFH output chart having an image ratio of 1% was used in evaluation in the N/L environment. An FFH output chart having an image ratio of 40% was used in evaluation in the H/H environment. FFH refers to a hexadecimal number on a 256 gray scale. 00H refers to the first on the gray scale (a white ground), and FFH refers to 256th on the 256 gray scale (solid black).

The number of image outputs depended on the evaluation item.

Conditions:

Paper Laser-beam printer sheet CS-814 (81.4 g/m$^2$) (Canon Marketing Japan Inc.)

Image forming speed 80 full-color A4 sheets per minute.

Developing conditions Any developing contrast could be chosen. An automatic correction function of the main body was disabled.

The peak-to-peak voltage (Vpp) of the alternating electric field could be changed between 0.7 and 1.8 kV in steps of 0.1 kV at a frequency of 2.0 kHz.

Images could be outputted in a single color.

The evaluation items are described below.

(1) Blank Dot

A chart having alternate bands of halftone transverse bands (30H 10 mm in width) and solid black transverse bands (FFH 10 mm in width) in the conveyance direction of a transferring material was outputted initially and immediately after the continuous passing of 2000 sheets in the N/L environment. The image was read with a scanner and was subjected to binarization. The luminance distribution (256 gray scale) of a line on the binarized image in the conveyance direction was measured. In a changing region from a solid black portion to a halftone portion, the sum of differences between an original luminance of the halftone portion and the measured luminance was considered to be the blank dot level. The original luminance of the halftone portion equals to a luminance at a rear end of the halftone portion. The blank dot level was rated according to the following criteria. The evaluation was performed only using a cyan color.

A: Less than 20

B: 20 or more and less than 30

C: 30 or more and less than 40

D: 40 or more and less than 50

E: 50 or more (2) Resistance to Coarseness of Halftone Image

After initial and endurance image output evaluation (50,000 sheets) in the H/H environment, an A4-sized halftone image (30H) was printed. The area of 1000 dots in the image was determined with a digital microscope VHX-500 (equipped with a wide-range zoom lens VH-Z100, manufactured by Keyence Corp.). The number-average dot area (S) and the standard deviation (σ) of the dot area were calculated. The dot reproducibility index was calculated from the following formula. The coarseness of the halftone image was rated using the dot reproducibility index (I).

$$\text{Dot reproducibility index } (I)=(\sigma/S)\times 100$$

The coarseness was rated only using a cyan color according to the following criteria.

A: I of less than 3.0

B: I of 3.0 or more and less than 5.0

C: I of 5.0 or more and less than 6.5

D: I of 6.5 or more and less than 8.0

E: I of 8.0 or more (3) Developing Performance after Long-Term Operation

In the evaluation of developing performance after long-term operation, the initial Vpp was fixed at 1.3 kV in the N/L environment, and the contrast potential was adjusted such that the reflection density of a cyan solid image was 1.50.

After printing of 20,000 sheets, the contrast potential was adjusted such that the image density was 1.50 at Vpp of 1.3 kV. This contrast potential was compared with the initial contrast potential. The evaluation was performed only using a cyan color.

The reflection density was measured with a 500 series spectrodensitometer (manufactured by X-Rite Inc.). Evaluation criteria for developing performance A: A difference from the initial value is less than 40 V.

B: A difference from the initial value is 40 V or more and less than 60 V.

C: A difference from the initial value is 60 V or more and less than 80 V.

D: A difference from the initial value is 80 V or more and less than 100 V.

E: A difference from the initial value is 100 V or more.

(4) Carrier Adhesion After Long-Term Operation

After the endurance image output evaluation in the N/L environment, the carrier adhesion was evaluated. During the output of a OOH image and an FFH image, the power supply was stopped. A sample was taken using a transparent adhesive tape from an electrostatic latent image bearing member before cleaning. The number of adhered carrier particles per square centimeter of the electrostatic latent image bearing member was determined by counting the number of magnetic carrier particles adhering to a 3 cm×3 cm area on the electrostatic latent image bearing member. The carrier adhesion was evaluated according to the following criteria. The evaluation was performed only using a cyan color.

A: 2 or less

B: 3 or more and 4 or less

C: 5 or more and 6 or less

D: 7 or more and 8 or less

E: 9 or more (5) Change in Gray Scale Due to Long-Time Operation

Pattern images having the following densities in the initial setting were outputted in the N/L environment immediately after the passing of 2000 sheets. A difference between the initial gray scale and the gray scale immediately after the passing of 2000 sheets was determined. The image density was measured with an X-Rite color reflection densitometer (Color reflection densitometer X-Rite 404A). The evaluation was performed only using a cyan color.

Pattern 1: 0.10 to 0.13
Pattern 2: 0.25 to 0.28
Pattern 3: 0.45 to 0.48
Pattern 4: 0.65 to 0.68
Pattern 5: 0.85 to 0.88
Pattern 6: 1.05 to 1.08
Pattern 7: 1.25 to 1.28
Pattern 8: 1.45 to 1.48

The criteria were as follows:

A: All the pattern images satisfy the density ranges.
B: One pattern image is out of the density ranges.
C: Two pattern images are out of the density ranges.
D: Three pattern images are out of the density ranges.
E: Four or more pattern images are out of the density ranges.

(6) Color Variation of Color Mixture

The color variation of red, which is a color mixture of yellow and magenta, was evaluated.

Before an endurance test, the developing contrast was adjusted such that each color solid image had a reflection density of 1.5. A red solid image was outputted immediately after the continuous passing of 2000 sheets in the N/L environment and immediately after the continuous passing of 2000 sheets in the H/H environment. The color variation due to the difference in environment was examined.

<Method for Measuring Difference in Color Variation>

The difference in color variation was measured as a* and b* with SpectroScan Transmission (manufactured by GretagMacbeth). The following is an example of the specific measurement conditions.

Measurement conditions
Observation light source: D50
Observation field of view: 2 degrees
Density: DIN NB
White standard: Pap
Filter: none In general, a* and b* are used in an L*a*b* color system, which is useful in converting colors into numbers. A combination of a* and b* indicates the hue. The hue is a measure of coloring, such as red, yellow, green, blue, or purple. Each of a* and b* indicates the direction of color. a* indicates a red-green direction, and b* indicates a yellow-blue direction. In the present invention, the difference in color variation (ΔC) is defined as follows:

$$\Delta C=\{(a^* \text{ of image in } HH \text{ environment}-a^* \text{ of image in } NL \text{ environment})^2+(b^* \text{ of image in } HH \text{ environment}-b^* \text{ of image in } NL \text{ environment})^2\}^{1/2}$$

Measurements at five points on an image were averaged. a* and b* of a solid image outputted in each of the environments were measured, and ΔC was calculated using the equation.

A: $0 \leq \Delta C < 2.0$
B: $2.0 \leq \Delta C < 3.5$
C: $3.5 \leq \Delta C < 5.0$
D: $5.0 \leq \Delta C < 6.5$
E: $6.5 \leq \Delta C$ (7) Evaluation of Scratch in Copying Machine Member In a 50,000-sheet endurance test in the N/L environment, an A4-sized FFH image was outputted for every 1000 sheets, and a copying machine member was checked for scratches, such as white streaks or spots, due to carrier scattering.

The evaluation criteria were based on the number of printed sheets when the A4-sized FFH image outputted for every 1000 sheets had 2 or more image defects, such as a white streak or spot. The evaluation was performed only using a cyan color.

A: No image defect even after the printing of 50,000 sheets.
B: An image defect occurs after the printing of 40,000 sheets or more.
C: An image defect occurs after the printing of 30,000 sheets or more.
D: An image defect occurs after the printing of 20,000 sheets or more.
E: An image defect occurs before the printing of 20,000 sheets.

(8) Overall Rating

The ratings for the evaluation items (1) to (7) were converted into numbers (A=5, B=4, C=3, D=2, E=0). The total numbers were rated according to the following criteria:

A: 46 or more and 50 or less
B: 39 or more and 45 or less
C: 30 or more and 38 or less
D: 20 or more and 29 or less
E: 19 or less Example 1 had very good results for all the evaluation items. Tables 9 and 10 show the results. Examples 2 to 18, Reference Example, and Comparative Examples 1 to 11

A two-component developer and a developer for replenishment were prepared in the same manner as in Example 1 except that the magnetic carriers 2 to 30 were used. Evaluation was performed in the same manner as in Example 1 except that these developers were used. Tables 9 and 10 show the results.

TABLE 9

| | Blank dot | | | | Coarseness | | | | Developability after long-term operation | | Carrier adhesion after long-term operation | | | |
|---|---|---|---|---|---|---|---|---|---|---|---|---|---|---|
| | | | After long-term operation | | | | | | | | 00H image | | FFH image | |
| | Initial | | | | Initial | | After long-term operation | | | | Number of carrier particles | | Number of carrier particles | |
| | Sum of differences | Rating | Sum of differences | Rating | (I) | Rating | (I) | Rating | Difference from initial (V) | Rating | (—) | Rating | (—) | Rating |
| Example 1 | 11 | A | 18 | A | 2.1 | A | 2.7 | A | 35 | A | 1 | A | 1 | A |
| Example 2 | 15 | A | 19 | A | 2.6 | A | 3.2 | B | 35 | A | 2 | A | 2 | A |
| Example 3 | 11 | A | 17 | A | 2.7 | A | 3.9 | B | 30 | A | 2 | A | 0 | A |
| Example 4 | 18 | A | 28 | B | 2.1 | A | 2.5 | A | 40 | B | 1 | A | 2 | A |
| Example 5 | 10 | A | 16 | A | 2.9 | A | 4.3 | B | 30 | A | 3 | B | 1 | A |
| Example 6 | 21 | B | 30 | C | 2.0 | A | 2.4 | A | 41 | B | 4 | B | 3 | B |

TABLE 9-continued

| | Blank dot | | | | Coarseness | | | | Developability | | Carrier adhesion after long-term operation | | | |
|---|---|---|---|---|---|---|---|---|---|---|---|---|---|---|
| | Initial | | After long-term operation | | Initial | | After long-term operation | | after long-term operation | | 00H image | | FFH image | |
| | Sum of differences | Rating | Sum of differences | Rating | (I) | Rating | (I) | Rating | Difference from initial (V) | Rating | Number of carrier particles (—) | Rating | Number of carrier particles (—) | Rating |
| Example 7 | 10 | A | 17 | A | 3.2 | B | 4.8 | B | 35 | A | 1 | A | 2 | A |
| Example 8 | 22 | B | 33 | C | 2.0 | A | 2.5 | A | 48 | B | 4 | B | 4 | B |
| Example 9 | 10 | A | 16 | A | 3.3 | B | 5.0 | C | 38 | A | 3 | B | 2 | A |
| Example 10 | 28 | B | 38 | C | 2.0 | A | 2.5 | A | 81 | D | 2 | A | 4 | B |
| Example 11 | 27 | B | 39 | C | 2.1 | A | 2.7 | A | 58 | B | 4 | B | 4 | B |
| Example 12 | 16 | A | 24 | B | 2.8 | A | 4.5 | B | 55 | B | 3 | B | 5 | C |
| Example 13 | 24 | B | 28 | B | 2.6 | A | 5.0 | C | 41 | B | 6 | C | 3 | B |
| Example 14 | 30 | C | 31 | C | 2.7 | A | 5.2 | C | 42 | B | 4 | B | 5 | C |
| Example 15 | 29 | B | 33 | C | 2.8 | A | 5.1 | C | 45 | B | 7 | D | 4 | B |
| Example 16 | 36 | C | 39 | C | 2.9 | A | 5.3 | C | 40 | B | 4 | B | 7 | D |
| Example 17 | 38 | C | 39 | C | 3.0 | B | 5.1 | C | 76 | C | 4 | B | 4 | B |
| Example 18 | 37 | C | 39 | C | 3.3 | B | 5.6 | C | 75 | C | 6 | C | 8 | D |
| Reference example 1 | 10 | A | 16 | A | 7.1 | D | 7.8 | D | 38 | A | 5 | C | 2 | A |
| Comparative example 1 | 11 | A | 16 | A | 7.3 | D | 8.3 | E | 58 | B | 7 | D | 6 | C |
| Comparative example 2 | 13 | A | 19 | A | 7.6 | D | 8.6 | E | 62 | C | 8 | D | 6 | C |
| Comparative example 3 | 36 | C | 50 | E | 2.1 | A | 2.6 | A | 89 | D | 5 | C | 7 | D |
| Comparative example 4 | 39 | C | 51 | E | 3.2 | B | 5.7 | C | 93 | D | 6 | C | 8 | D |
| Comparative example 5 | 15 | A | 19 | A | 8.4 | E | 9.5 | E | 43 | B | 9 | E | 6 | C |
| Comparative example 6 | 13 | A | 19 | A | 8.8 | E | 9.9 | E | 46 | B | 10 | E | 6 | C |
| Comparative example 7 | 42 | D | 51 | E | 2.4 | A | 2.9 | A | 96 | D | 6 | C | 9 | E |
| Comparative example 8 | 51 | E | 58 | E | 2.2 | A | 2.6 | A | 101 | E | 7 | D | 10 | E |
| Comparative example 9 | 46 | D | 36 | C | 8.6 | E | 6.7 | E | 57 | B | 9 | E | 8 | D |
| Comparative example 10 | 53 | E | 59 | E | 3.6 | B | 7.5 | D | 61 | C | 9 | E | 9 | E |
| Comparative example 11 | 26 | B | 37 | C | 7.3 | D | 7.8 | D | 76 | C | 6 | D | 6 | E |

TABLE 10

| | Change in Gray Scale density | | | Scratch in copying machine member | | Red hue (a* b*) | | | | | | Overall rating | |
|---|---|---|---|---|---|---|---|---|---|---|---|---|---|
| | *Pattern number outside range | Number of patterns outside range (—) | Rating | Number of sheets having image defects (—) | Rating | After HH endurance a* | After HH endurance b* | After NL endurance a* | After NL endurance b* | Difference in color variation ΔC | Rating | Total numbers | Rating |
| Example 1 | — | 0 | A | — | A | 44.98 | 37.46 | 44.25 | 36.31 | 1.36 | A | 50 | A |
| Example 2 | 5 | 1 | B | — | A | 45.95 | 36.88 | 43.44 | 36.37 | 2.56 | B | 47 | A |
| Example 3 | — | 0 | A | — | A | 44.76 | 37.58 | 43.75 | 36.11 | 1.78 | A | 49 | A |
| Example 4 | — | 0 | A | — | A | 44.67 | 36.57 | 43.05 | 35.85 | 1.77 | A | 48 | A |
| Example 5 | — | 0 | A | — | A | 44.85 | 36.83 | 43.59 | 35.41 | 1.90 | A | 48 | A |
| Example 6 | 6 | 1 | B | — | A | 43.58 | 38.03 | 42.22 | 37.15 | 1.62 | A | 43 | B |
| Example 7 | 2, 3 | 2 | C | 48000 | B | 44.90 | 37.47 | 43.57 | 37.36 | 1.73 | A | 45 | B |
| Example 8 | 5, 6 | 2 | C | — | A | 44.79 | 38.04 | 43.46 | 36.47 | 1.86 | A | 42 | B |
| Example 9 | 2, 3, 4 | 3 | C | 42000 | B | 44.81 | 38.14 | 44.21 | 36.24 | 1.99 | A | 43 | B |
| Example 10 | 5, 6 | 2 | C | — | A | 44.21 | 37.13 | 42.09 | 35.89 | 2.46 | B | 40 | B |
| Example 11 | 5, 6, 7 | 3 | C | 38000 | C | 45.21 | 38.93 | 43.69 | 36.44 | 2.92 | B | 39 | B |
| Example 12 | 4, 5, 6 | 3 | C | — | A | 44.33 | 37.03 | 42.02 | 35.59 | 2.72 | B | 41 | B |
| Example 13 | 4, 5, 6 | 3 | C | 35000 | C | 45.46 | 39.01 | 43.74 | 36.24 | 3.26 | B | 37 | C |
| Example 14 | 2, 3, 4 | 3 | C | — | A | 44.55 | 36.95 | 42.81 | 34.24 | 3.22 | B | 37 | C |
| Example 15 | 2, 3 | 2 | C | 30000 | C | 46.11 | 36.95 | 43.48 | 33.98 | 3.97 | C | 34 | C |

TABLE 10-continued

| | Change in Gray Scale density | | | Scratch in copying machine member | | Red hue (a* b*) | | | | | | | |
|---|---|---|---|---|---|---|---|---|---|---|---|---|---|
| | *Pattern number outside range | Number of patterns outside range (—) | Rating | Number of sheets having image defects (—) | Rating | After HH endurance a* | After HH endurance b* | After NL endurance a* | After NL endurance b* | Difference in color variation ΔC | Rating | Overall rating Total numbers | Rating |
| Example 16 | 3, 4, 5, 6 | 4 | D | — | A | 44.79 | 38.04 | 41.46 | 35.44 | 4.22 | C | 34 | C |
| Example 17 | 2, 3, 4, 5 | 4 | D | 28000 | D | 47.22 | 38.54 | 43.21 | 35.30 | 5.16 | D | 30 | C |
| Example 18 | 3, 4, 5, 6 | 4 | D | — | A | 44.61 | 38.14 | 41.38 | 34.44 | 4.91 | C | 30 | C |
| Reference example 1 | 2, 3 | 2 | C | — | A | 47.11 | 38.12 | 44.64 | 36.48 | 2.96 | B | 39 | B |
| Comparative example 1 | 2, 3, 4, 5 | 4 | D | 36000 | C | 47.00 | 38.74 | 43.20 | 34.93 | 5.38 | D | 28 | D |
| Comparative example 2 | 2, 5, 6, 7 | 4 | D | 34000 | C | 47.75 | 38.74 | 43.91 | 34.18 | 5.96 | D | 27 | D |
| Comparative example 3 | 2, 3, 4, 5, 6, 7 | 6 | E | 41000 | B | 44.22 | 37.22 | 37.67 | 36.79 | 6.56 | E | 24 | D |
| Comparative example 4 | 2, 3, 4, 5, 6, 7 | 6 | E | 41000 | B | 44.27 | 36.93 | 38.41 | 33.68 | 6.70 | E | 21 | D |
| Comparative example 5 | 2, 5 | 2 | C | 26000 | D | 46.40 | 36.85 | 43.22 | 34.01 | 4.26 | C | 25 | D |
| Comparative example 6 | 2, 3, 4, 6 | 4 | D | 24000 | D | 44.55 | 37.03 | 41.19 | 33.08 | 5.19 | D | 23 | D |
| Comparative example 7 | 2, 3, 4, 6, 7 | 5 | D | 32000 | C | 44.97 | 36.89 | 39.71 | 32.68 | 6.74 | E | 22 | D |
| Comparative example 8 | 2, 3, 5, 6, 7, 8 | 6 | E | 24000 | D | 44.75 | 36.82 | 38.57 | 33.78 | 6.89 | E | 14 | E |
| Comparative example 9 | 3, 4, 5, 6, 7, 8 | 6 | E | 28000 | D | 45.25 | 37.03 | 40.19 | 32.78 | 6.61 | E | 13 | E |
| Comparative example 10 | 3, 4, 5 | 3 | C | 18000 | E | 44.11 | 37.03 | 40.19 | 33.08 | 5.56 | D | 14 | E |
| Comparative example 11 | 2, 3, 4, 5, 6, 7 | 6 | E | 15000 | E | 42.87 | 37.35 | 38.27 | 31.94 | 7.10 | E | 18 | E |

*Pattern number having a gray scale outside the specified range after the passing of 2000 sheets While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-113775 filed May 30, 2013, which is hereby incorporated by reference herein in its entirety.

What is claimed is:

1. A magnetic carrier, comprising:

a resin-filled magnetic core particle, which is constituted by a porous magnetic particle and a resin disposed in pores of the porous magnetic particle; and a resin covering layer provided on a surface of the resin-filled magnetic core particle, wherein a resin for use in the resin covering layer is a copolymer of:

a vinyl monomer having a cyclic hydrocarbon group in its molecular structure, and another vinyl monomer, wherein the porous magnetic particle has a peak pore diameter of 0.40 μm or more and 0.88 μm or less, the peak pore diameter providing the maximum differential pore volume in the pore diameter range of 0.1 μm or more and 3.0 μm or less, wherein the magnetic carrier has a 50% particle diameter (D50) of 30.0 μm or more and 80.0 μm or less on a volume basis, and an electric current flowing through the magnetic carrier at a voltage of 500 V ranges from 8.0 to 50.0 μA, and wherein a proportion JR1 of a composition that is made up of the resin in a magnetic carrier portion of a region R1 and a proportion JR2 of the composition in a magnetic carrier portion of a region R2 satisfy the following relationship:

$$1.20 \leq JR2/JR1 \leq 2.00$$

wherein the region R1 is defined as:

a line segment having a maximum length is drawn on a cross section image of the magnetic carrier, two straight lines A and B that are parallel to the line segment and are separated from the line segment by 2.5 μm are drawn, a straight line C that passes through a point of contact between the line segment and a surface of the resin-filled magnetic core particle and is perpendicular to the line segment is drawn, a straight line D that is parallel to the straight line C, is closer to the center of the magnetic carrier than the straight line C, and is separated from the straight line C by 5.0 μm is drawn, and the region R1 refers to a region surrounded by the straight lines A, B, and D and a circumference of the resin-filled magnetic core particle, and wherein the region R2 is defined as:

a straight line E that is parallel to the straight line D, is closer to the center of the magnetic carrier than the straight line D, and is separated from the straight line D by 5.0 μm is drawn, and the region R2 refers to a region surrounded by the straight lines A, B, D, and E.

2. The magnetic carrier according to claim 1, wherein pores of the porous magnetic particle having a pore diameter of 0.1 μm or more and 3.0 μm or less have a pore volume of 20 $mm^3/g$ or more and 100 $mm^3/g$ or less, the pore volume being an accumulated value of differential pore volumes.

3. The magnetic carrier according to claim 1, wherein the amount of resin of the magnetic carrier is 3.0 parts by mass or more and 9.0 parts by mass or less per 100 parts by mass of the porous magnetic particle.

4. The magnetic carrier according to claim 1, wherein the magnetic carrier has a specific resistance of $1.0\times10^7$ Ω·cm or more and $1.0\times10^{10}$ Ω·cm or less at an electric field strength of 2000 V/cm.

5. The magnetic carrier according to claim 1, wherein the porous magnetic particle has a specific resistance of $1.0\times10^7$ Ω·cm or more and $1.0\times10^9$ Ω·cm or less at an electric field strength of 300 V/cm.

6. A two-component developer, comprising a toner and a magnetic carrier, the toner containing a binder resin, a colorant, and a release agent, wherein the magnetic carrier is the magnetic carrier according to claim 1.

7. An image forming method, comprising: charging an electrostatic latent image bearing member; forming an electrostatic latent image on a surface of the electrostatic latent image bearing member; developing the electrostatic latent image using a two-component developer in a developing unit to form a toner image; transferring the toner image to a transfer material optionally via an intermediate transfer member; and fixing the transferred toner image on the transfer material, wherein the two-component developer is the two-component developer according to claim 6.

8. An image forming method, comprising: charging an electrostatic latent image bearing member; forming an electrostatic latent image on a surface of the electrostatic latent image bearing member; developing the electrostatic latent image using a two-component developer in a developing unit to form a toner image; transferring the toner image to a transfer material optionally via an intermediate transfer member; and fixing the transferred toner image on the transfer material, wherein a developer for replenishment is supplied to the developing unit in response to a decrease in the concentration of toner in the two-component developer in the developing unit and, if necessary, an excess of the magnetic carrier in the developing unit is discharged from the developing unit, the developer for replenishment contains a magnetic carrier for replenishment and a toner, the toner containing a binder resin, a colorant, and a release agent, and the amount of toner is 2 parts by mass or more and 50 parts by mass or less per part by mass of the magnetic carrier for replenishment, and the magnetic carrier for replenishment is the magnetic carrier according to claim 1.

9. A developer for replenishment for use in an image forming method, the image forming method comprising: charging an electrostatic latent image bearing member; forming an electrostatic latent image on a surface of the electrostatic latent image bearing member; developing the electrostatic latent image using a two-component developer in a developing unit to form a toner image; transferring the toner image to a transfer material optionally via an intermediate transfer member; and fixing the transferred toner image on the transfer material, wherein the developer for replenishment is supplied to the developing unit in response to a decrease in the concentration of toner in the two-component developer in the developing unit and, if necessary, an excess of the magnetic carrier in the developing unit is discharged from the developing unit, the developer for replenishment contains a magnetic carrier for replenishment and a toner, the toner containing a binder resin, a colorant, and a release agent, and the amount of toner is 2 parts by mass or more and 50 parts by mass or less per part by mass of the magnetic carrier for replenishment, and the magnetic carrier for replenishment is the magnetic carrier according to claim 1.

10. The magnetic carrier according to claim 1, wherein the resin disposed in pores of the porous magnetic particle is a silicone resin.

11. The magnetic carrier according to claim 1, wherein the cyclic hydrocarbon group is at least one selected from the group consisting of a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, and a bornyl group.

* * * * *